US007524040B2

(12) United States Patent
Kusakari

(10) Patent No.: US 7,524,040 B2
(45) Date of Patent: Apr. 28, 2009

(54) LIQUID EJECTION HEAD AND LIQUID EJECTION APPARATUS

(75) Inventor: Tsutomu Kusakari, Kanagawa (JP)

(73) Assignee: Fujifilm Corp., Tokyo (JP)

( * ) Notice: Subject to any disclaimer, the term of this patent is extended or adjusted under 35 U.S.C. 154(b) by 493 days.

(21) Appl. No.: 11/452,220

(22) Filed: Jun. 14, 2006

(65) Prior Publication Data

US 2006/0290737 A1 Dec. 28, 2006

(30) Foreign Application Priority Data

Jun. 15, 2005 (JP) ..... 2005-175534

(51) Int. Cl.
*B41J 2/045* (2006.01)

(52) U.S. Cl. ..... 347/68

(58) Field of Classification Search ..... 347/68–72
See application file for complete search history.

(56) References Cited

U.S. PATENT DOCUMENTS 5,757,392 A 5/1998 Zhang 7,121,651 B2 * 10/2006 Takahashi et al. ..... 347/71

FOREIGN PATENT DOCUMENTS

| | | |
|---|---|---|
| JP | 55-118878 A | 9/1980 |
| JP | 6-155733 A | 6/1994 |
| JP | 7-132592 A | 5/1995 |

* cited by examiner

*Primary Examiner*—K. Feggins
(74) *Attorney, Agent, or Firm*—Birch, Stewart, Kolasch & Birch, LLP

(57) ABSTRACT

The liquid ejection head comprises: an ejection hole which ejects liquid; a pressure chamber which accommodates the liquid to be ejected from the ejection hole; an ejection force generating element which applies an ejection force to the liquid inside the pressure chamber; and a pressure measurement device including a capacitance-type pressure measurement element which measures pressure generated in the pressure chamber, the pressure measurement device having a resistance and a capacitance whereby frequency f and cut-off frequency $f_C$ of a measurement signal obtained from the pressure measurement element in accordance with the pressure generated in the pressure chamber satisfy a relationship of $f<f_C$.

8 Claims, 14 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus, and more particularly, to abnormal ejection determination technology in a liquid ejection head which ejects liquid from nozzles.

2. Description of the Related Art

In an inkjet system which ejects ink from nozzles by applying pressure to ink accommodated inside pressure chambers, a method has been proposed for measuring the pressure inside the pressure chambers by means of pressure sensors and thereby ascertaining the ejection state of the ink. The pressure wave generated in a pressure chamber is high-speed and high-frequency, and the measurement signal obtained from the pressure sensor is a signal having a very weak voltage. Therefore, the difference between normal operation and abnormal operation is small, and hence it is difficult to distinguish between normal operation and abnormal operation. Various methods have been proposed in order to accurately judge normal operation and abnormal operation from a measurement signal having a very weak voltage of this kind.

Japanese Patent Application Publication No. 7-132592 discloses that a measurement drive pulse is applied to a piezoelectric element prior to a printing operation, and the pressure variation inside the pressure chamber is measured by means of the piezoelectric element and the measurement circuit, in addition to which a drive waveform is calculated on the basis of the characteristics of this pressure variation, and during printing, a drive voltage waveform is applied to the piezoelectric element on the basis of the calculated drive waveform.

Japanese Patent Application Publication No. 55-118878 discloses that a measurement device is provided in order to determine the state of displacement of a vibrating element which deforms an ink chamber in response to an electrical signal, and the state of displacement of the vibrating element with respect to the electrical signal is evaluated.

Japanese Patent Application Publication No. 6-155733 discloses that drive pulse signals are applied to a piezoelectric element by a drive element and the piezoelectric element thereby deforms a plurality of times in a short period of time so that the ink inside the ink chamber is gradually ejected and one ink droplet is formed by this ink. During this, a determination device determines the variation in the ink inside the ink chamber at each occurrence of a prescribed pulse of the drive pulse signal, and a control device controls the drive element in such a manner that a pulse following the prescribed pulse is generated on the basis of the determination results of the determination device.

In general, a method for determining the pressure in a pressure chamber includes a method of determining pressure abnormalities by measuring the absolute amplitude of the pressure wave, or a method of determining pressure abnormalities by measuring the frequency characteristics of the pressure wave. In the method that measures the absolute amplitude of the pressure wave, if there is not a very large difference between the absolute amplitude of the pressure wave during normal operation and the absolute amplitude of the pressure wave during abnormal operation, then it becomes difficult to accurately judge between normal operation and abnormal operation. In the method that measures the frequency characteristics of the pressure wave, the system for measuring the frequency of the pressure wave is complicated. More specifically, a composition is possible in which the frequency is measured by using a frequency filter, such as a low-pass filter, a high-pass filter, or a band-pass filter, and in a composition of this kind, there is a problem in that a filter device must be provided in the signal processing unit which processes the signal obtained from the sensors, and therefore the system becomes complicated.

In Japanese Patent Application Publication No. 7-132592, the measurement drive signal is required in order to determine the pressure variation within the pressure chamber, and therefore a device for generating this measurement drive signal, and a storage device for storing the measurement drive signal, are necessary. Hence, there is a problem in that the control system becomes large in scale.

In Japanese Patent Application Publication No. 55-118878, a high-pass filter for acquiring a high-frequency component from the measurement signal is required, and there is a problem in that the circuitry of the signal processing system becomes large in scale.

In Japanese Patent Application Publication No. 6-155733, a timing circuit is required in order to determine the residual vibration of the pressure chamber at each occurrence of a prescribed number of pulses, and furthermore, the calculation unit that generates a subsequent pulse on the basis of the residual vibration must be capable of high-speed processing.

SUMMARY OF THE INVENTION

The present invention has been contrived in view of the foregoing circumstances, an object thereof being to provide a liquid ejection head and a liquid ejection apparatus capable of good pressure measurement, by means of a simple composition.

In order to attain the aforementioned object, the present invention is directed to a liquid ejection head, comprising: an ejection hole which ejects liquid; a pressure chamber which accommodates the liquid to be ejected from the ejection hole; an ejection force generating element which applies an ejection force to the liquid inside the pressure chamber; and a pressure measurement device including a capacitance-type pressure measurement element which measures pressure generated in the pressure chamber, the pressure measurement device having a resistance and a capacitance whereby frequency f and cut-off frequency $f_C$ of a measurement signal obtained from the pressure measurement element in accordance with the pressure generated in the pressure chamber satisfy a relationship of $f<f_C$.

According to the present invention, the resistance component and the capacitance component of the pressure measurement devices having capacitance-type pressure measurement elements are specified in such a manner that the relationship between the frequency f of the measurement signal obtained from the pressure measurement element in accordance with the pressure generated in the pressure chamber, and the cut-off frequency $f_C$, is $f<f_C$. Therefore, the voltage of the measurement signal (the output voltage of the pressure measurement element) changes in accordance with frequency variation in the measurement signal, and hence the frequency variation in the pressure wave generated in the pressure chamber can be determined highly accurately. Furthermore, it is possible to detect abnormal ejection in the ejection hole connected to the pressure chamber in question, on the basis of these measurement results.

Here, the cut-off frequency $f_C$ indicates the frequency of the measurement signal corresponding to an output voltage that is $1/(2^{1/2})$ of the maximum generated voltage (saturation voltage) of the pressure measurement element. In other words, in the range where the frequency f of the measurement signal obtained from the pressure measurement element is less than the cut-off frequency $f_C$, the voltage of the measurement signal changes in accordance with the change in the frequency of the measurement signal.

A composition should be adopted in such a manner that, of the frequencies f of the measurement signal, at least the frequency region $f_S$ that is to be determined satisfies the relationship of $f_S<f_C$. The lower limit of the frequency $f_S$ to be determined is set appropriately in accordance with the noise component level in the measurement signal and the processing resolution of the measurement signal. For example, a frequency corresponding to a voltage which exceeds five times the noise component in the measurement signal may be used as the lower limit value of the frequency to be determined.

The pressure measurement device includes, at least, a capacitance-type pressure measurement element, and it may also include peripheral circuits of the pressure measurement element, and the like.

The liquid ejection head may be a line type head having a row of ejection holes of a length corresponding to the full width of the recording medium (the width of the possible image formation region of the recording medium), or a serial head which uses a short head having an ejection hole row of a length that does not reach the full width of the recording medium, and which scans this head in the breadthways direction of the recording medium.

A line ejection head may be formed to a length corresponding to the full width of the recording medium by combining short head having rows of ejection holes which do not reach a length corresponding to the full width of the recording medium, these short heads being joined together in a staggered matrix fashion.

A piezoelectric element made of PVDF (polyvinylidene fluoride) or PZT (lead zirconate titanate), or the like, is suitable for use as a capacitance-type pressure measurement element. Desirably, a piezoelectric element having a large value of the mechanical-electrical conversion constant (g constant) is used for the pressure measurement element, and if a piezoelectric element is used for the ejection force generating element, then it is possible to combine the pressure measurement element and the ejection force generating element in one element. The pressure measurement element may be provided inside the pressure chamber, or it may be provided on the outside of the pressure chamber.

Preferably, the frequency f of the measurement signal includes frequency $f_0$ of the measurement signal obtained for the pressure generated in the pressure chamber during normal ejection where the liquid is ejected normally from the ejection hole.

According to this aspect of the present invention, by setting the frequency $f_0$ of the measurement signal obtained from the pressure measurement element during normal ejection to be less than the cut-off frequency $f_C$ of the measurement signal, it is possible accurately to determine a pressure wave occurring in a pressure chamber in which the frequency has reduced in comparison with normal ejection.

The frequency $f_0$ of the measurement signal obtained from the pressure measurement element during normal ejection includes the resonance frequency of the pressure chamber.

Preferably, the frequency f of the measurement signal includes frequency $f_1$ of the measurement signal obtained for the pressure generated in the pressure chamber during abnormal ejection where the liquid is not ejected normally from the ejection hole.

According to this aspect of the present invention, by setting the frequency $f_1$ of the measurement signal obtained from the pressure measurement element in the case of abnormal ejection to be less than the cut-off frequency $f_C$ of the measurement signal, then it is possible accurately to detect abnormal ejection of a kind which causes the frequency of the pressure wave generated in the pressure chamber to vary.

Even more desirable pressure measurement can be achieved in a case where the frequency $f_1$ of the measurement signal in the case of abnormal ejection satisfies the condition of being smaller than the frequency $f_0$ of the measurement signal during normal ejection (i.e., $f_0>f_1$).

Preferably, the abnormal ejection includes a state where a bubble is present in the pressure chamber.

If a bubble removal device for removing bubbles inside the pressure chambers is provided, and if it is judged that a bubble has occurred inside the pressure chamber due to pressure abnormality in the pressure chamber, then control should be implemented in order to remove the bubbles inside the pressure chambers by means of the bubble removal device. The bubble removal device may be a suction device which suctions the liquid inside the pressure chamber, via the nozzle.

Here, reference to "a state where a bubble is present in the pressure chamber" may be a state where air dissolved inside the ink in the pressure chamber has turned into vapor due to a temperature change inside the pressure chamber, or the like, or a state where a bubble has infiltrated from outside the pressure chamber, via the nozzle, or the like.

Preferably, the pressure measurement element has an output electrode through which the measurement signal is outputted, and the capacitance of the pressure measurement device is settled by at least one of a surface area of the output electrode, and a thickness of the pressure measurement element.

It is possible to adjust the capacitance of the pressure measurement device by means of the surface area of the output electrode of the pressure measurement element, and it is also possible to adjust the capacitance of the pressure measurement device by means of the thickness of the pressure measurement element. Furthermore, it is also possible to adjust the capacitance of the pressure measurement device by means of both the surface area of the output electrode and the thickness.

Preferably, the pressure measurement device has a signal transmission path which transmits the measurement signal obtained from the pressure measurement element; and the resistance of the pressure measurement device includes a resistance of the signal transmission path, and the capacitance of the pressure measurement device includes a capacitance of the signal transmission path.

By adjusting the resistance and the capacitance of the pressure measurement device by means of the resistance component and the capacitance component of the signal transmission path along which the measurement signal is transmitted, the freedom of choice of the pressure measurement device is increased, and the composition of the pressure measurement device can also be simplified.

Preferably, the resistance of the pressure measurement device includes resistance of a resistor added to the signal transmission path, and the capacitance of the pressure measurement device includes capacitance of a capacitor added to the signal transmission path.

By adjusting the resistance and the capacitance of the pressure measurement device by adding at least one of a resistor and a capacitor to the signal transmission path, the freedom of choice of the pressure measurement device is increased, and the composition of the pressure measurement device can also be simplified.

In order to attain the aforementioned object, the present invention is also directed to a liquid ejection apparatus, comprising: a liquid ejection head which comprises: an ejection hole which ejects liquid; a pressure chamber which accommodates the liquid to be ejected from the ejection hole; an ejection force generating element which applies an ejection force to the liquid inside the pressure chamber; and a pressure measurement device including a capacitance-type pressure measurement element which measures pressure generated in the pressure chamber, the pressure measurement device having a resistance and a capacitance whereby frequency f and cut-off frequency $f_C$ of a measurement signal obtained from the pressure measurement element in accordance with the pressure generated in the pressure chamber satisfy a relationship of $f<f_C$; and a signal processing device which carries out prescribed signal processing on the measurement signal obtained from the pressure measurement element, wherein the resistance of the pressure measurement device includes an input resistance of the signal processing device.

According to the present invention, since the input resistance of the signal processing device which carries out prescribed signal processing on the measurement signal is set in such a manner that the frequency f of the measurement signal is less than the cut-off frequency $f_C$, then it is possible accurately to measure the frequency of the pressure wave generated in the pressure chamber, without modifying the composition of the liquid ejection head. The signal processing device may be provided in the liquid ejection head, or it may be provided outside the liquid ejection head.

According to the present invention, since a composition is adopted in which the frequency f of the measurement signal obtained from the pressure measurement element is less than the cut-off frequency $f_C$ of the pressure measurement element, then the voltage of the measurement signal (the output voltage of the pressure measurement element) changes in accordance with frequency variation in the measurement signal, and hence the frequency variation of the pressure wave generated in the pressure chamber can be determined with good accuracy.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
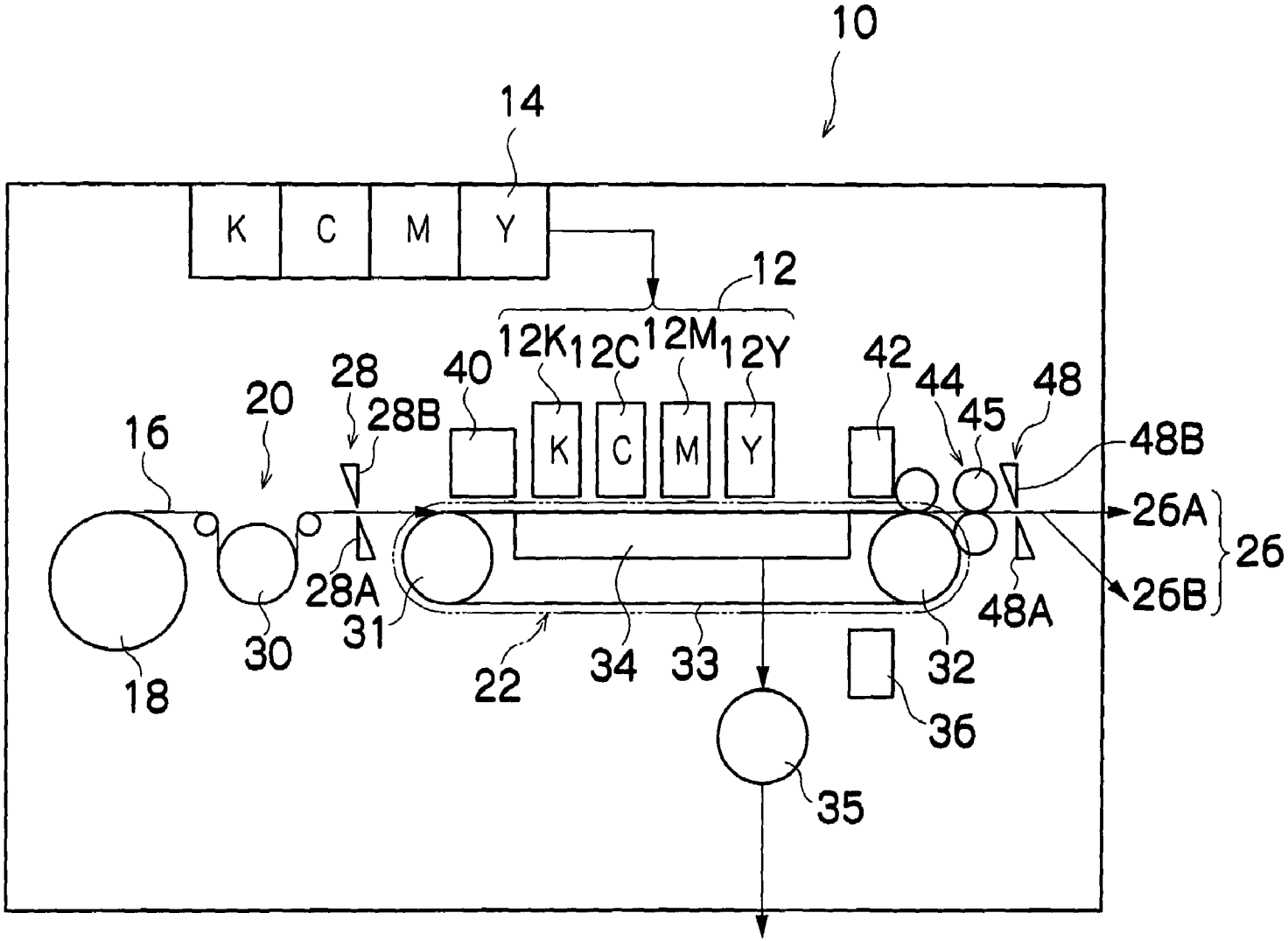
FIG. 1 is a general schematic drawing of an inkjet recording apparatus according to an embodiment of the present invention.

FIG. 1 is a general configuration diagram of an inkjet recording apparatus according to an embodiment of the present invention. As shown in FIG. 1, the inkjet recording apparatus 10 comprises: a printing unit 12 having a plurality of inkjet heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; and a paper output unit 26 for outputting image-printed recording paper (printed matter) to the exterior.

The ink storing and loading unit 14 has ink supply tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (shown as a motor 88 in FIG. 5) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
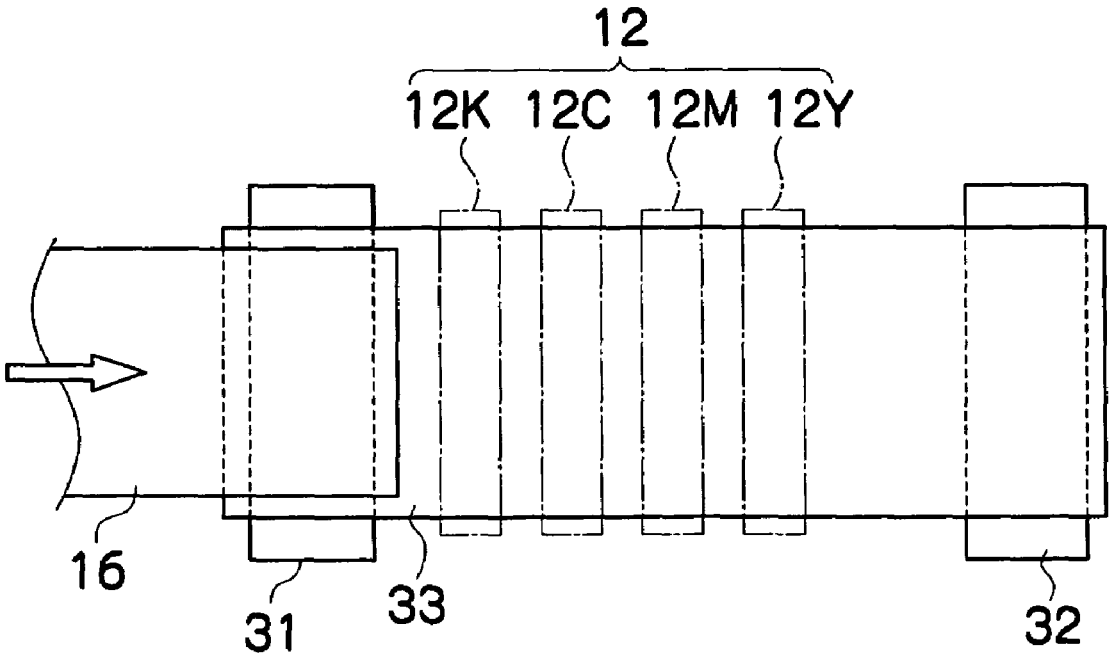
FIG. 2 is a principal plan diagram of the peripheral area of a printing unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the printing unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head is described. The heads 12K, 12C, 12M and 12Y of the respective ink colors have the same structure, and a reference numeral 50 is hereinafter designated to any of the heads.

Figure 3A:
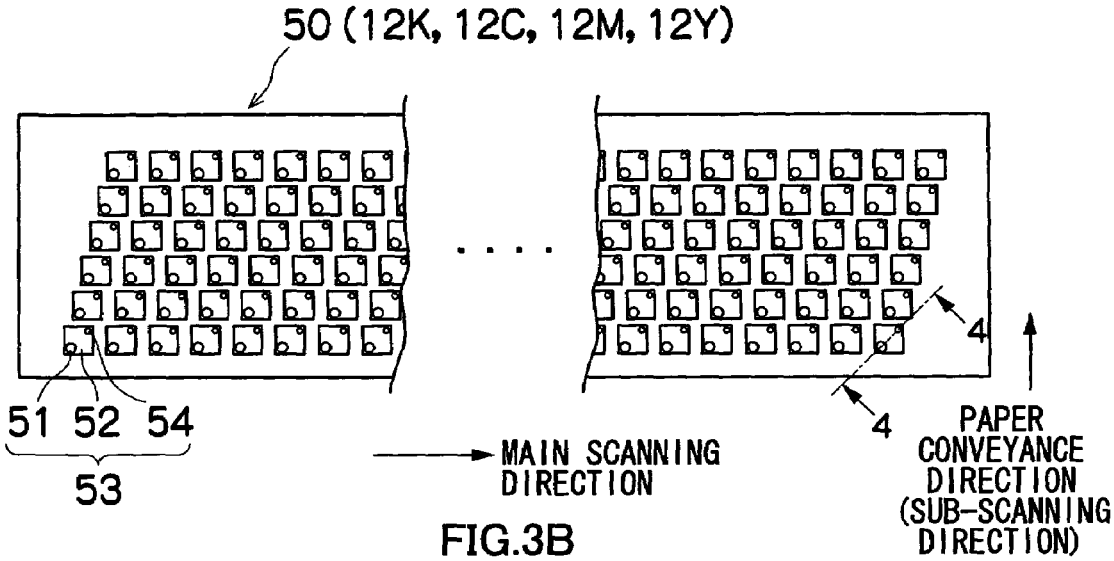
FIGS. 3A to 3C are plan view perspective diagrams showing examples of the composition of a print head.
Figure 3B:
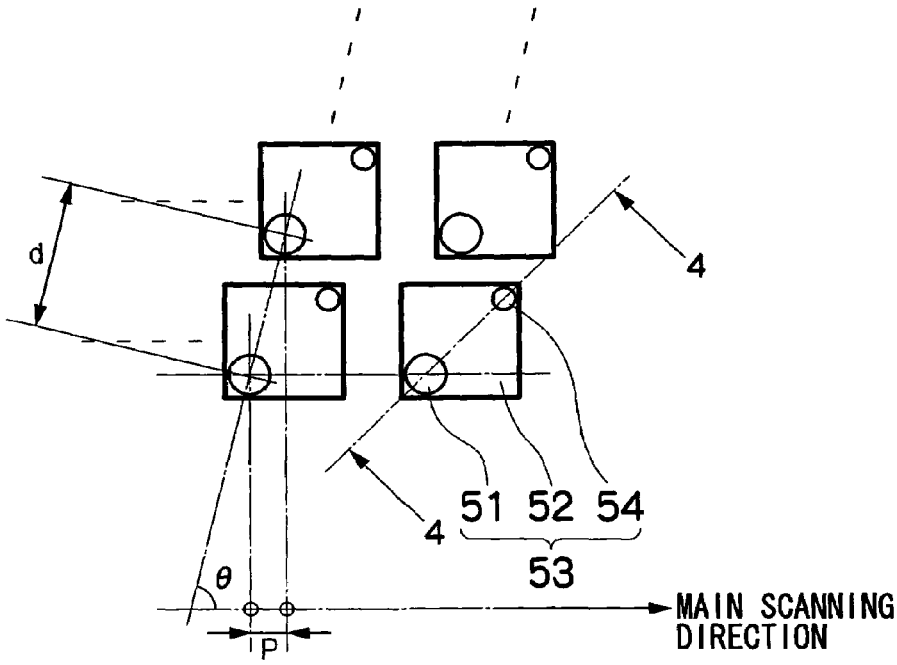
Figure 3C:
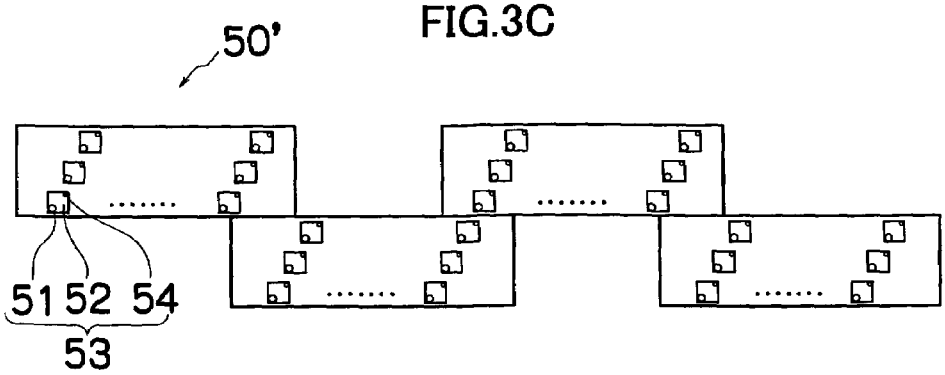
Figure 4:
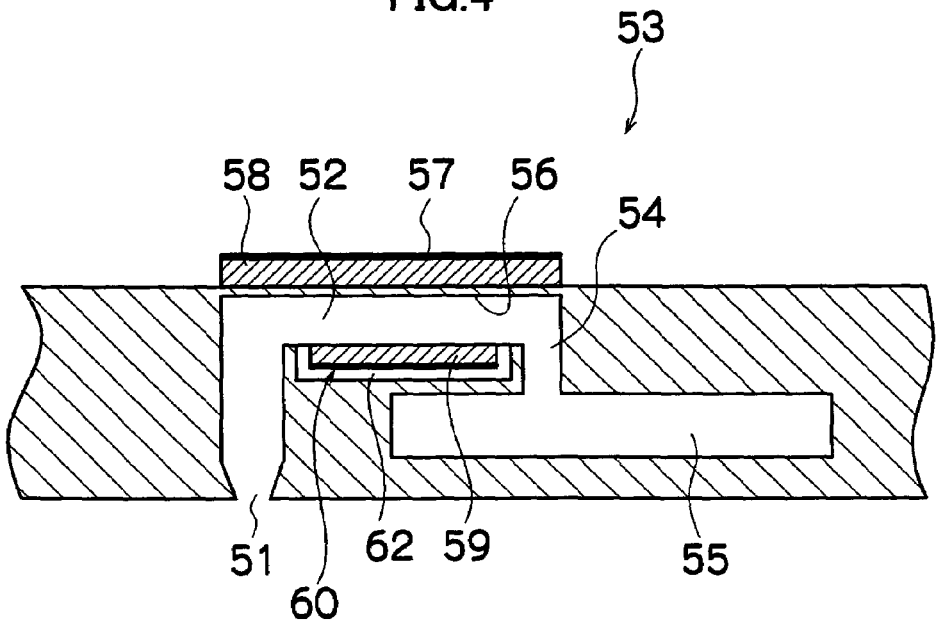
FIG. 4 is a cross-sectional diagram along line 4-4 in FIGS. 3A and 3B.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view showing a three-dimensional composition of an ink chamber unit (being a cross-sectional view along line 4-4 in FIGS. 3A and 3B). The nozzle pitch in the head 50 should be minimized in order to maximize the resolution of the dots printed on the surface of the recording paper 16. As shown in FIGS. 3A and 3B, the head 50 according to the present embodiment has a structure in which a plurality of ink chamber units 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main-scanning direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via the supply port 54 to a common flow channel 55. The common flow channel 55 is connected to an ink supply tank which forms an ink source (not shown in FIGS. 3A to 3C, and represented by the ink storing and loading unit 14 in FIG. 1). The ink supplied from the ink supply tank is distributed and supplied to the respective pressure chambers 52 via the common flow channel 55 in FIG. 4.

A piezoelectric actuator 58 (ejection force generating element) provided with an individual electrode 57 is bonded to a pressure plate 56 which forms the upper face of the pressure chambers 52 and also serves as a common electrode, and the piezoelectric actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

When a pressure sensor 59 (pressure measurement element) provided on a side of the pressure chamber 52 opposite to the side adjacent to the piezoelectric actuator 58 receives a pressure due to ink ejection, refilling, or the like, then a distortion (stress) according to this pressure is generated in the pressure sensor 59, and it is possible to obtain a voltage according to this distortion (pressure variation) from an output electrode (individual electrode) 60 provided on a side of the pressure sensor 59 opposite to the side adjacent to the pressure chamber 52, as a measurement signal. A cavity section 62 is provided on the side of the pressure sensor 59 opposite to the side adjacent to the pressure chamber 52, in such a manner that the displacement of the pressure sensor 59 is not impeded.

In the inkjet recording apparatus 10, the pressure (pressure wave) of the pressure chamber 52 is measured by the measurement signal obtained from the pressure sensor 59, and the pressure abnormality of the pressure chamber 52 is detected on the basis of this pressure wave.

In general, if pressure abnormality occurs in the pressure chamber 52, then a state may occur in which ink is not ejected normally from the nozzle 51, even when a prescribed ejection force is applied by the piezoelectric actuator 58 (for example, ejection volume abnormality in which a prescribed volume of ink is not ejected). The occurrence of bubbles, or the like, inside the pressure chamber 52 may be one reason for pressure abnormality in the pressure chamber 52.

For the piezoelectric actuator 58 shown in FIG. 4, it is suitable to adopt a piezoelectric element using a ceramic material, such as PZT ($Pb(Zr,Ti)O_3$, lead zirconate titanate), or the like. For the pressure sensor 59, it is suitable to adopt a piezoelectric element using a fluororesin material, such as a PVDF (polyvinylidene fluoride) and PVDF-TrFE (copolymer of polyvinylidene fluoride and trifluoroethylene). Of course, it is also possible to adopt a piezoelectric element using a ceramic material, such as PZT or PLZT (lead lanthanum zirconate titanate) for the pressure sensor 59, and a mode is also possible in which the piezoelectric actuator 58 is also used as the pressure sensor 59.

In general, for a piezoelectric element which generates an ejection force, it is desirable to use a piezoelectric element having a large absolute value of the equivalent piezoelectric constant (d constant, electrical-mechanical conversion constant, piezoelectric strain constant) and excellent drive characteristics; whereas for a sensor which measures pressure, it is desirable to use a piezoelectric element having a large value of the piezoelectric output coefficient (g constant, mechanical-electrical conversion constant, piezoelectric stress constant) and excellent measurement characteristics. In other words, a ceramic piezoelectric material is suitable for a piezoelectric element having excellent drive characteristics, whereas a fluororesin type piezoelectric material, such as PVDF and PVDF-TrFE, is suitable for a piezoelectric element having excellent measurement characteristics. One embodiment of a ceramic piezoelectric material is PZT. PZT is mainly composed of lead titanate ($PbTiO_3$), which is a ferroelectric material, and lead zirconate ($PbZrO_3$), which is an antiferroelectric material, and it is possible to control various properties of PZT, such as the piezoelectricity, the dielectricity and the elastic characteristics, by changing the ratio in which these two components are combined.

The piezoelectric actuator 58, which applies an ejection force to the ink inside the pressure chamber 52, and the pressure sensor 59, which measures the pressure inside the pressure chamber 52, are not restricted to being located in the positions shown in FIG. 4, and they may be arranged on the same wall of the pressure chamber 52, or on different walls of the pressure chamber 52. The details of the abnormal ejection determination control for determining abnormal ejection on the basis of the pressure (pressure variation) in the pressure chamber 52 described above is explained later.

As shown in FIG. 3B, the high-density nozzle head according to the present embodiment is achieved by composing a plurality of ink chamber units 53 having this structure in a lattice arrangement, based on a fixed arrangement pattern having a row direction which coincides with the main scanning direction, and a column direction which is inclined at a fixed angle of θ with respect to the main scanning direction, rather than being perpendicular to the main scanning direction.

More specifically, by adopting a structure in which the plurality of ink chamber units 53 are arranged at a uniform pitch d in line with a direction forming the angle of θ with respect to the main scanning direction, the pitch P of the nozzles projected to an alignment in the main scanning direction is d×cos θ, and hence it is possible to treat the nozzles 51 as if they are arranged linearly at a uniform pitch of P. By means of this composition, it is possible to achieve a nozzle composition of high density, in which the nozzle columns projected to an alignment in the main scanning direction reach a total of 2400 per inch (2400 nozzles per inch).

When implementing the present invention, the arrangement structure of the nozzles is not limited to the example shown in the drawings, and it is also possible to apply various other types of nozzle arrangements, such as an arrangement structure having one nozzle row in the sub-scanning direction.

Description of Control System

Figure 5:
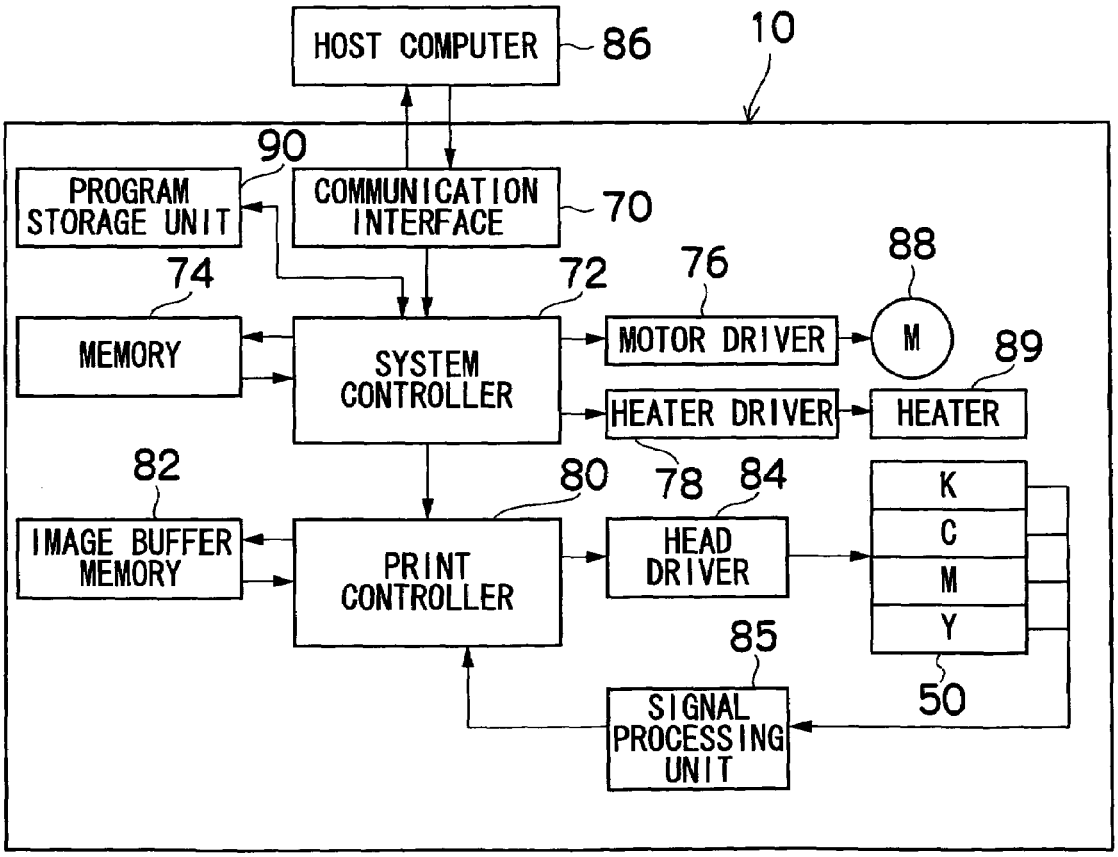
FIG. 5 is a principal block diagram showing the system configuration of the inkjet recording apparatus shown in FIG. 1.

FIG. 5 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, a signal processing unit 85, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, and the like, as well as controlling communications with the host computer 86 and writing and reading to and from the memory 74, and it also generates control signals for controlling the motor 88 such as a motor in the conveyance system and the heater 89 such as a heater in the post-drying unit 42.

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (drive circuit) which drives the motor 88 in accordance with instructions from the system controller 72. The heater driver 78 is a driver which drives the heaters 89, such as the temperature adjustment heater in the head 50, and the heaters in the post-drying unit 42 and the inkjet recording apparatus 10, in accordance with instructions from the system controller 72.

The print controller 80 has a signal processing function for performing various tasks, compensations, and other types of processing for generating print control signals from the image data stored in the memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the piezoelectric actuators 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is ejected from the head 50. By controlling ink ejection from the heads 50 in synchronization with the conveyance velocity of the recording paper 16, an image is formed on the recording paper 16.

The signal processing unit 85 shown in FIG. 5 is a signal processing unit which carries out prescribed signal processes, such as noise reduction and amplification, with respect to the measurement signals obtained from the pressure sensors 59 in accordance with the pressure change in the pressure chambers 52, such as that shown in FIG. 4. In the inkjet recording apparatus 10, the measurement signal which has been subjected to prescribed signal processing by the signal processing unit 85 is sent to the print controller 80, and the print controller 80 determines the pressure abnormality in the pressure chamber 52 on the basis of this measurement signal. For example, a mode is possible in which the measurement signal is compared with a previously established threshold value and pressure abnormality is determined on the basis of the result of this comparison.

Abnormal ejection in the nozzle 51 connected to the pressure chamber 52 is detected on the basis of the result of the pressure measurement in that pressure chamber 52, which is determined as described above. The details of pressure determination (abnormal ejection determination) in the pressure chambers 52 of the inkjet recording apparatus 10 are described later.

Various control programs are stored in a program storage unit 90 shown in FIG. 5, and the control programs are read out and executed in accordance with commands from the system controller 72. The program storage unit 90 may use a semiconductor memory, such as a ROM, EEPROM, or a magnetic disk, or the like, and an external interface may be provided to use a memory card or PC card. Naturally, a plurality of these storage media may also be provided. The program storage unit 90 may also be combined with a storage device for storing operational parameters, and the like (not shown).

In the present embodiment, the system controller 72, memory 74, print controller 80, and the like, forming functional blocks are depicted as separate blocks, but they may also be integrated so as to form one processor. Furthermore, it is also possible to achieve a portion of the functions of the system controller 72 and a portion of the functions of the print controller 80, by means of one processor.

Description of Pressure Measurement; First Embodiment

Figure 6:
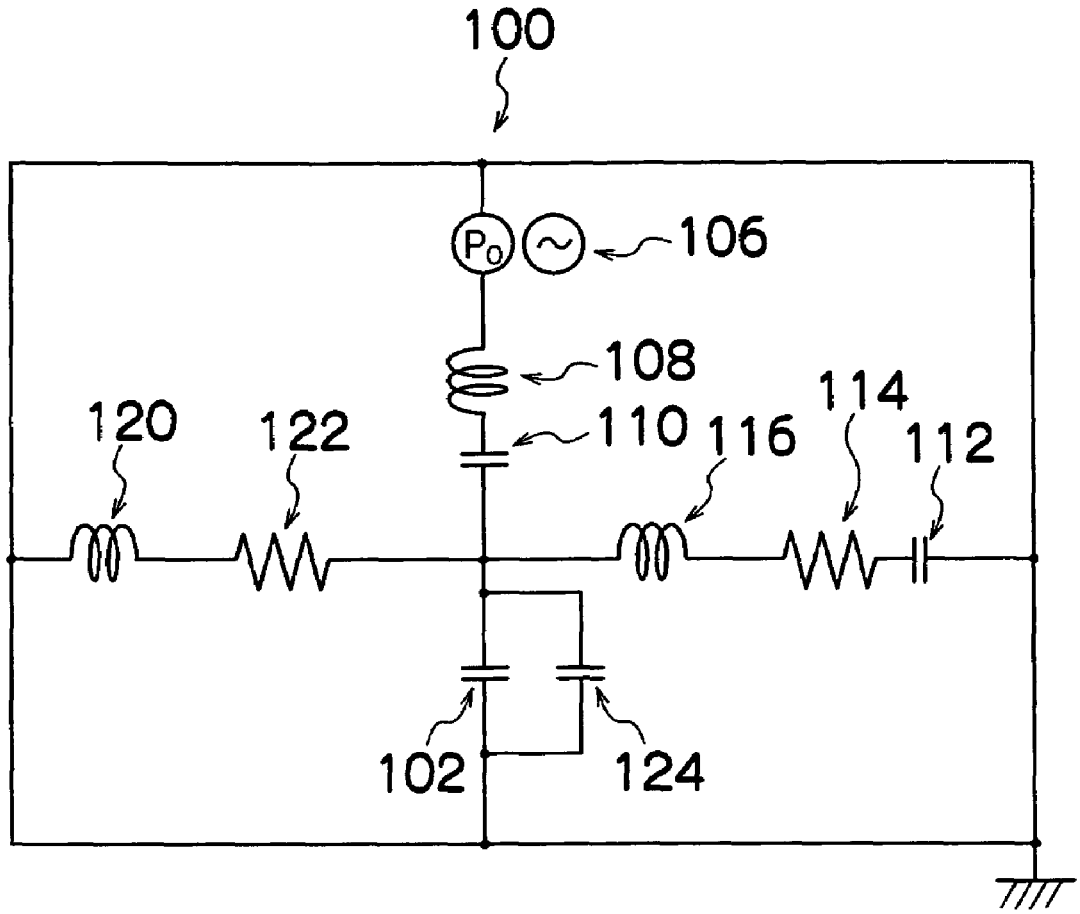
FIG. 6 is an equivalent circuit model in which the pressure generated in the pressure chamber shown in FIGS. 3A and 3B is calculated by means of a lumped constant model.

Next, the measurement of the pressure in the pressure chamber 52 is described in detail. FIG. 6 shows an equivalent circuit model 100 in which the pressure generated in the pressure chamber 52 provided in the head 50 shown in FIGS. 3A to 3C, and the like, is calculated by a lumped constant model. In this equivalent circuit model 100, reference numeral 102 represents the compliance (compressive properties) of the pressure chamber 52. The pressure (P0) 106 generated in the pressure chamber 52 by the pressure applied by the piezoelectric actuator 58, the inertance (inertia) 108 of the piezoelectric actuator 58, and the compliance 110 of the piezoelectric actuator 58, are connected in series to the compliance 102 of the pressure chamber 52. Furthermore, an ejection side load including the compliance 112 of the nozzle 51, the fluid resistance 114 of the nozzle 51, and the inertance 116 of the nozzle 51, mutually connected in series, and a supply side load including the inertance 120 of the supply side and the fluid resistance 122 of the supply side, mutually connected in series, are connected in parallel to the compliance 102 of the pressure chamber 52.

As shown in FIG. 6, if a bubble occurs inside the pressure chamber 52, then this is equivalent to the compliance 124 of the bubble being connected in parallel to the compliance 102 of the pressure chamber 52. By using the equivalent circuit model 100, it is possible to estimate the frequency and magnitude of the pressure (pressure wave) occurring in the pressure chamber 52 when a bubble occurs inside the pressure chamber 52.

In the present embodiment, it is supposed that the bubble that would affect ink ejection has a size (diameter) of approximately 7 μm to 10 μm or above, the pressure loss in the pressure chamber 52 due to the occurrence of the bubble is approximately 10% or above, and the decrease in the resonance frequency of the pressure chamber 52 due to the occurrence of the bubble is approximately 10% or above.

Figure 7A:
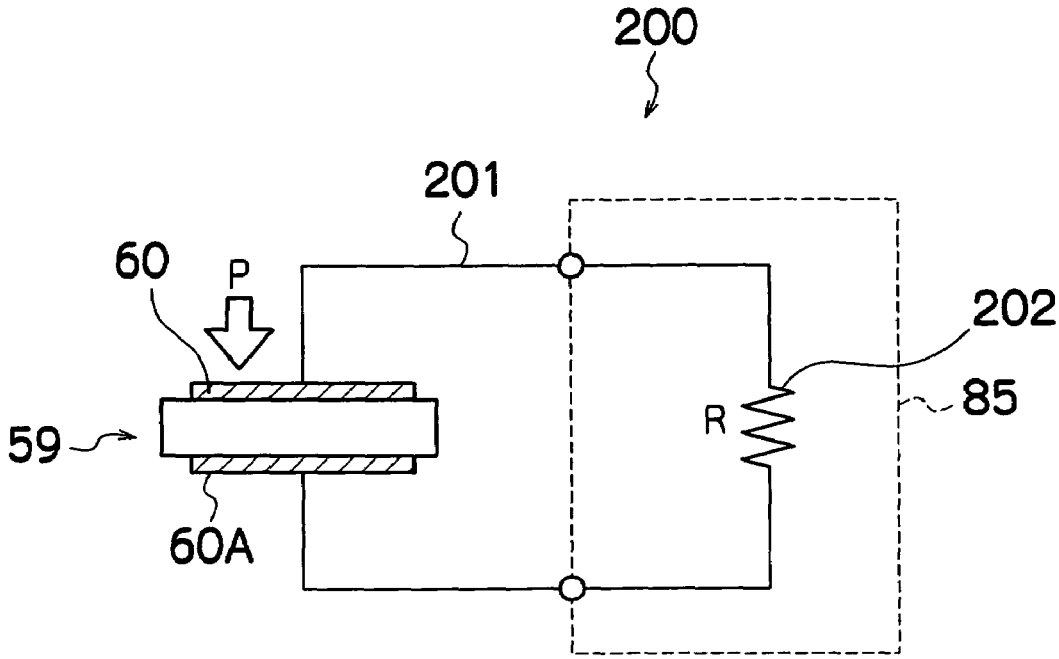
FIGS. 7A and 7B are equivalent circuit models of the pressure sensor shown in FIG. 4.

Next, the structure of the pressure sensor 59 is described. FIG. 7A shows a model of a pressure measurement device 200, which comprises a pressure sensor 59, individual electrodes 60 and 60A, a wire 201 and a signal processing unit 85. As shown in FIG. 7A, the pressure sensor 59 is provided with the individual electrodes 60 and 60A forming the output electrodes, and a measurement signal (output voltage) generated between the electrodes in accordance with the pressure $P_0$ (unit: pascal (Pa)) in the pressure chamber 52 is sent to the signal processing unit 85 (indicated by the broken line). In the signal processing unit 85, the measurement signal is acquired through the input resistance 202 (R; unit: ohm (Ω)), and prescribed signal processing is carried out by means of the subsequent processing circuit (not shown).

Figure 7B:
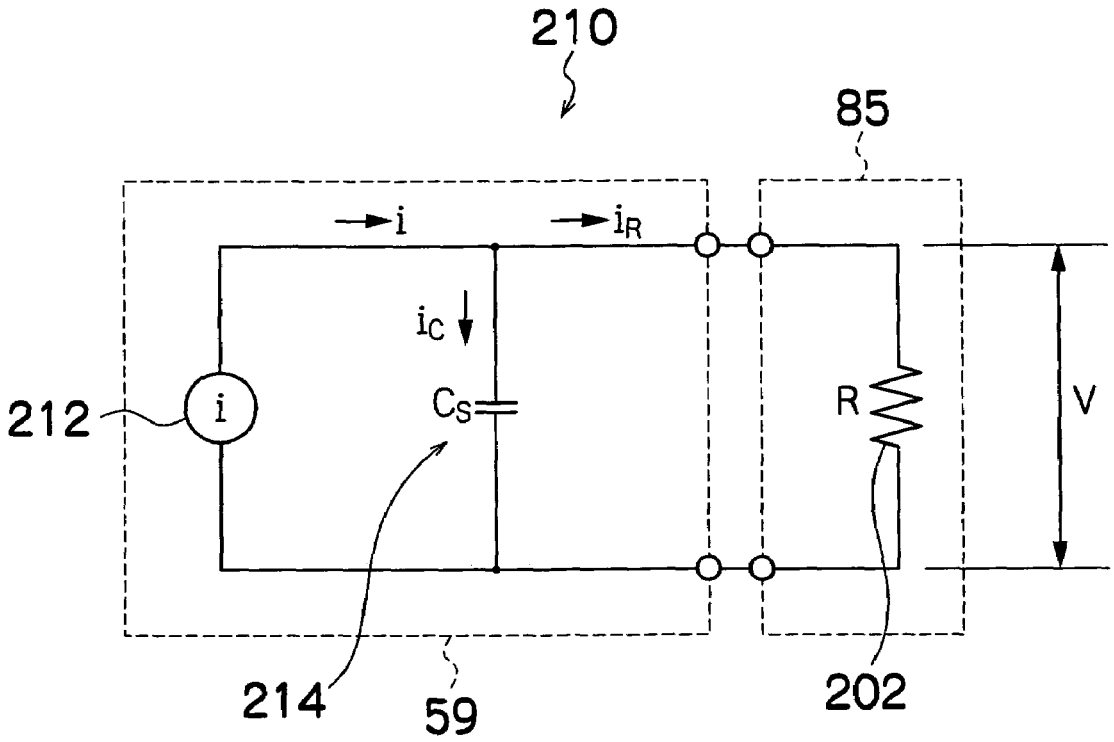

FIG. 7B shows an equivalent circuit model 210 corresponding to the model of the pressure measurement device 200 shown in FIG. 7A, in order to calculate the pressure generated on the pressure measurement device 200 described above, by means of a lumped constant model.

In this equivalent circuit model 210, the pressure sensor 59 is constituted by a current generator 212 and the compliance (capacitance) 214 ($C_S$; unit: farad (F)) connected in parallel to the current generator 212. The current i (unit: ampere (A)) generated by the current generator 212 is divided into a component $i_C$, which flows through the capacitance (C, compliance) 214 of the pressure sensor 59, and a component $i_R$, which flows through the input resistance 202 of the signal processing unit 85. In other words, the current i generated by the current generator 212 is represented as:

$$i=i_C+i_R. \tag{1}$$

where $i_C$ is the current component flowing in the capacitance 214 of the pressure sensor 59, and $i_R$ is the current component flowing in the input resistance 202 of the signal processing unit 85.

Here, if the pressure applied to the pressure sensor 59 is taken to be $x_0$ (unit: Pa), then the sinusoidal pressure x applied to the pressure sensor 59 can be written as:

$$x=x_0\times\exp(j\times\omega\times t). \tag{2}$$

Then, the charge Q (unit: coulomb (C)) generated by the pressure sensor 59 due to the pressure x expressed by the above formula (2) is represented as:

$$Q=S\times g_3\times x, \tag{3}$$

where S is the surface area (unit: $m^2$) of the individual electrode 60 of the pressure sensor 59, and $g_3$ is the piezoelectric constant (unit: C/N) of the pressure sensor 59.

The current i generated by the pressure sensor 59 is represented as:

$$i = \frac{\partial Q}{\partial t} = \frac{\partial (S \times g_3 \times x)}{\partial t} = S \times g_3 \times j \times \omega \times x, \quad (4)$$

and the voltage (output voltage) V (unit: volt (V)) generated between the individual electrodes 60 and 60A of the pressure sensor 59 is represented by the following formulas (5) and (6):

$$V = i_R \times R; \text{ and} \quad (5)$$

$$V = i_C/(j \times \omega \times C_S). \quad (6)$$

The capacitance $C_S$ of the pressure sensor 59 is written as:

$$C_S = (\epsilon_0 \times \epsilon' \times S)/T, \quad (7)$$

where $\epsilon_0$ is the dielectric constant of vacuum (unit: F/m), $\epsilon'$ is the relative dielectric constant of the pressure sensor 59 (piezoelectric body), T is the thickness (unit: m) of the pressure sensor 59, and S is the surface area of the individual electrode 60 of the pressure sensor 59.

By rearranging the above-described formulas (4) to (6), the output voltage V of the pressure sensor 59 can be expressed as:

$$V = (j \times \omega \times S \times g_3 \times R)/(1 + j \times \omega \times C_S \times R). \quad (8)$$

According to the above formula (8), the angular frequency $\omega_C$ corresponding to the cut-off frequency $f_C$ is expressed as:

$$\omega_C = 1/(C_S \times R), \quad (9)$$

and the cut-off frequency $f_C (= \omega/(2 \times \pi))$ is then written as:

$$f_C = 1/(2 \times \pi \times C_S \times R). \quad (10)$$

Taking the maximum value of the output voltage V to be $V_{MAX} (= S \times g_3 \times x/C_S)$, the output voltage V corresponding to this cut-off frequency $f_C$ is $V_{MAX}/(2^{1/2})$.

Figure 8:
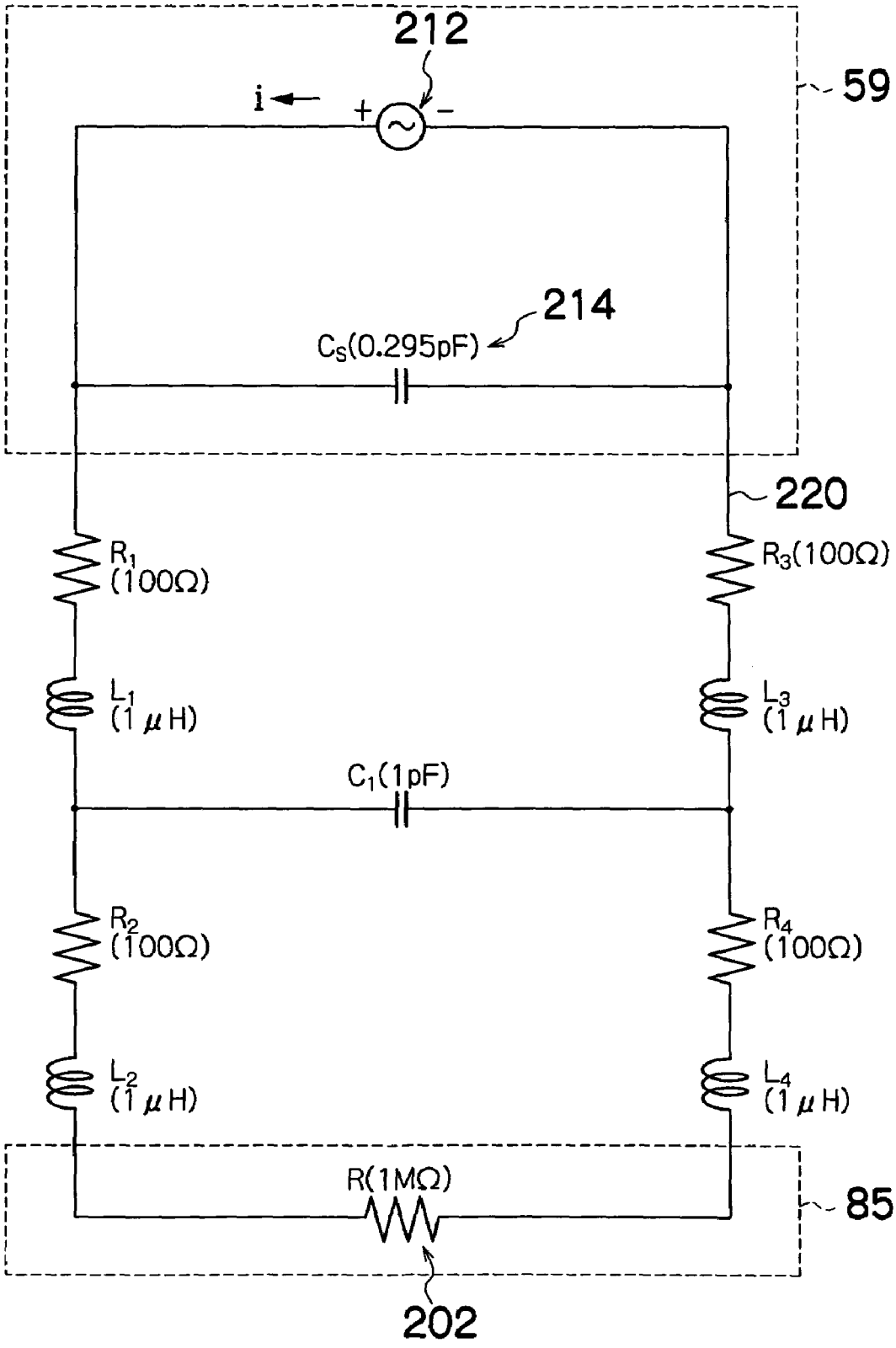
FIG. 8 is a diagram showing the wire resistance, wire capacitance, and wire inductance of a measurement signal transmission path.

As shown in FIG. 8, the transmission path (wire) 220, which carries the measurement signal between the pressure sensor 59 and the signal processing unit 85, has the wire resistances $R_1$ to $R_4$, the dielectric loads (inductance components of the wire 220) $L_1$ to $L_4$, and the capacitive load (wire capacitance of the wire 220) $C_1$. For example, the wire resistances $R_1$ to $R_4$ are 100 Ω, which is a relatively small value compared to the input resistance R (e.g., 1 MΩ) of the signal processing unit 85, the wire capacitance $C_1$ is approximately 1 pF, and the capacitance $C_S$ of the pressure sensor 59 is approximately 0.295 pF. The values of the dielectric loads $L_1$ to $L_4$ shown in FIG. 8 are, for example, approximately 1 μH. The wire resistances $R_1$ to $R_4$ and the dielectric loads $L_1$ to $L_4$ having these values have little effect on the measurement signal, and are of a level which can be ignored. Furthermore, although the wire capacitance $C_1$ may have an effect on the measurement signal, the degree of attenuation of the measurement signal due to the wire capacitance $C_1$ is not significant.

Next, the frequency characteristics of the measurement signal obtained from the pressure sensor 59 are described with reference to FIG. 9. The two axes of the frequency characteristics chart 300 of the measurement signal shown in FIG. 9 are represented in logarithmic scale.

Figure 9:
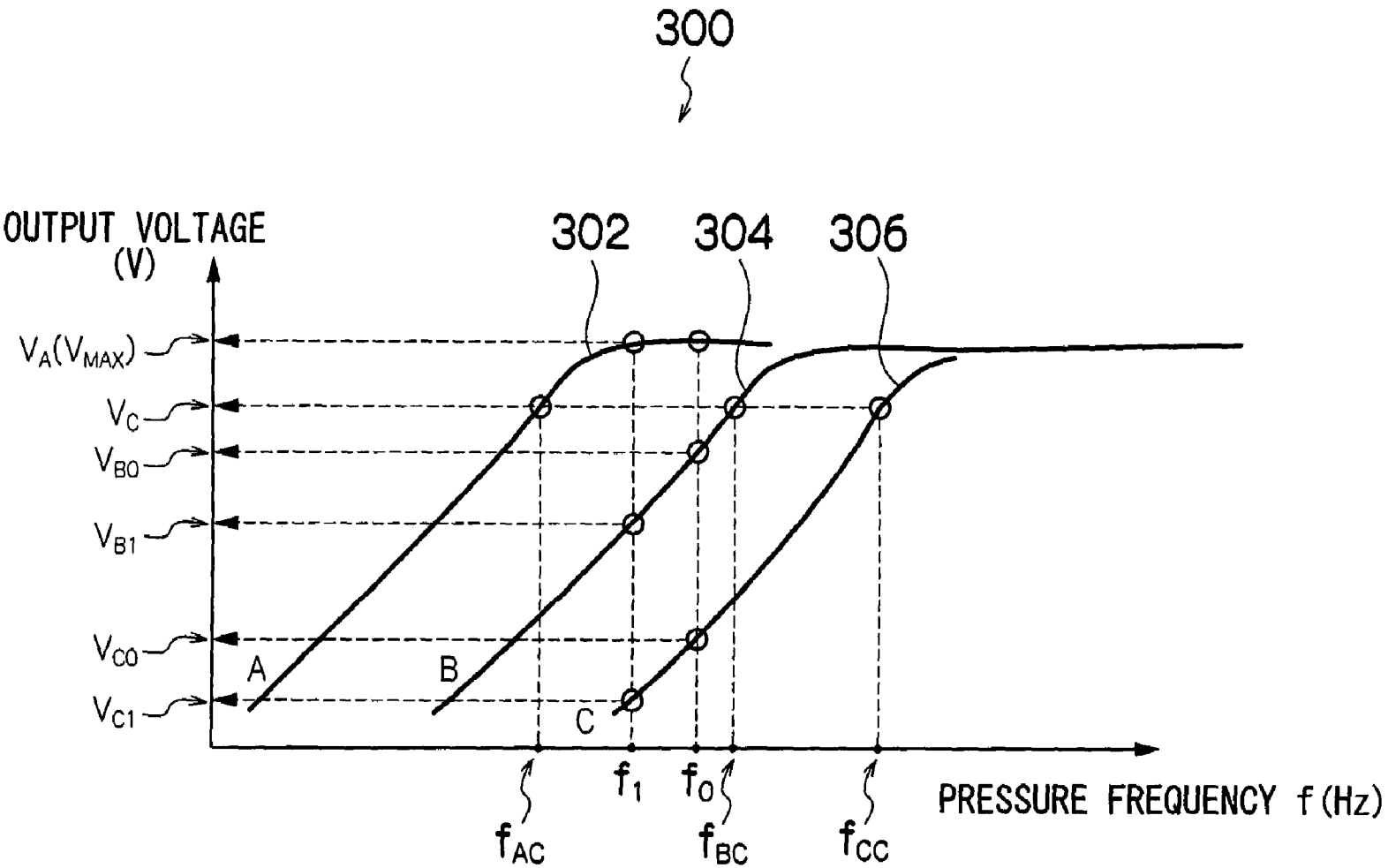
FIG. 9 is a diagram illustrating the frequency characteristics of a measurement signal.

As described in FIG. 9, in the measurement signal obtained from the pressure sensor 59, the output voltage V increases when the frequency rises, and if the frequency exceeds a certain value, then the output voltage V becomes saturated and assumes a uniform voltage $V_{MAX}$.

The frequency characteristics curves 302(A), 304(B) and 306(C) shown in FIG. 9 indicate the frequency characteristics of measurement signals having different frequencies at which the output voltage V becomes the maximum value $V_{MAX}$. In other words, the frequency characteristics curves 302, 304 and 306 represent the frequency characteristics of measurement signals having different values for the term ($C_S \times R$) in the above-described formula (10).

The value $f_0$ in FIG. 9 is the frequency of the measurement signal corresponding to the pressure wave x generated in the pressure chamber 52 during normal ejection, and the resonance frequency of the pressure chamber 52 is included in the driving action (for example, a pull-push-pull driving action), which uses resonance between the pressure chamber 52 and the drive signal applied to the piezoelectric actuator 58.

The value $f_1$ in FIG. 9 is the frequency of the measurement signal corresponding to the pressure wave x generated in the pressure chamber 52 when a bubble that effects ejection occurs in the pressure chamber 52 (in the case of abnormal ejection), and the frequency $f_1$ is lower than the frequency $f_0$ of the pressure wave x generated in the pressure chamber 52 in the case of normal ejection. In a state where the frequency of the pressure wave generated in the pressure chamber 52 is lower than the frequency of the pressure wave generated in the pressure chamber 52 during normal ejection, then there may have been an increase in the viscosity of the ink inside the pressure chamber 52, a fault in the piezoelectric actuator 58, or the like.

In the present embodiment, the pressure $P_0$ generated in the pressure chamber 52 (in other words, applied to the pressure sensor 59) during normal ejection (where $P_0$ corresponds to the value $x_0$ in the above-described formula (2)) is considered to be approximately 1 MPa to 2 MPa, and the frequency $f_0$ of the pressure $P_0$ generated in the pressure chamber 52 in this case is considered to be approximately 250 kHz.

On the other hand, the pressure $P_1$ generated in the pressure chamber 52 when a bubble occurs in the pressure chamber 52 is considered to be approximately 90% of the pressure $P_0$ in the case of normal ejection (i.e., $P_1 = P_0 \times 0.9$), and the frequency $f_1$ of the pressure generated in the pressure chamber 52 in this case is considered to be approximately 90% of the frequency $f_0$ in the case of normal ejection (i.e., $f_1 = f_0 \times 0.9$).

In the present embodiment, the frequency range of the measurement signal (the frequency $f_S$ of the signal to be measured) is set to 100 kHz to 300 kHz, in accordance with the frequencies of the pressure waves generated in the pressure chamber 52 in the case of normal ejection and the case of abnormal ejection, as supposed above.

The values $f_{AC}$, $f_{BC}$ and $f_{CC}$ in FIG. 9 indicate the cut-off frequencies of the frequency characteristics curves 302, 304 and 306, respectively. In other words, the frequencies corresponding to the value $V_C$ (where $V_C = V_{MAX}/2^{1/2}$) of the output voltage V in the frequency characteristics curves 302, 304 and 306 are the cut-off frequencies in the frequency characteristics curves, respectively.

In the measurement of the pressure in the pressure chamber 52 in the present embodiment, the capacitance $C_S$ of the pressure sensor 59 and the input resistance R of the signal processing unit 85 shown in FIG. 7B are set in such a manner that the frequency characteristics of the pressure sensor 59 follow the frequency characteristics curve 304. In other words, the capacitance $C_S$ of the pressure sensor 59 and the input resistance R of the signal processing unit 85 are set in such a manner that the frequency $f_0$ of the pressure $P_0$ generated during normal ejection and the frequency of the pressure $P_1$ generated in the case of abnormal ejection cover a range in which the output voltage V changes in a virtually linear fashion with variation in the frequency (in other words, in such a manner that the frequency $f_S$ of the signal to be measured lies on the inclined portion of each frequency characteristics curve). More specifically, when the cut-off frequencies $f_{AC}$, $f_{BC}$ and $f_{CC}$ of the frequency characteristics curves 302, 304 and 306 are represented generally as the cut-off frequency $f_C$, then the capacitance $C_S$ of the pressure sensor 59 and the input resistance R of the signal processing unit 85 are set in such a manner that the cut-off frequency $f_C$ and the frequency $f_0$ of the pressure $P_0$ generated during normal ejection satisfy the following relationship:

$$f_C > f_0, \tag{11}$$

and that the cut-off frequency $f_C$ and the frequency $f_1$ of the pressure $P_1$ generated during abnormal ejection satisfy the following relationship:

$$f_C > f_1. \tag{12}$$

Furthermore, the frequency $f_S$ of the signal to be measured and the cut-off frequency $f_C$ satisfy the following relationship:

$$f_C > f_S. \tag{13}$$

In general, if a capacitance-type pressure sensor is used in the related art, then in order to eliminate the effects of the frequency characteristics of the pressure sensor 59, the capacitance $C_S$ of the pressure sensor 59 and the input resistance R of the signal processing unit 85 are set in such a manner that the cut-off frequency $f_C$, the frequency $f_0$ of the pressure generated during normal ejection, and the frequency $f_1$ of the pressure generated in the case of the abnormal ejection have the characteristics indicated by the frequency characteristics curve 302 in FIG. 9 (in other words, in such a manner that the frequency of the pressure to be measured lies in a range higher than the cut-off frequency $f_C$). In the frequency characteristics curve 302 shown in FIG. 9, the value of the output value V is $V_A$ ($V_{MAX}$) when the frequency is $f_0$ and when the frequency is $f_1$.

Figure 10A:
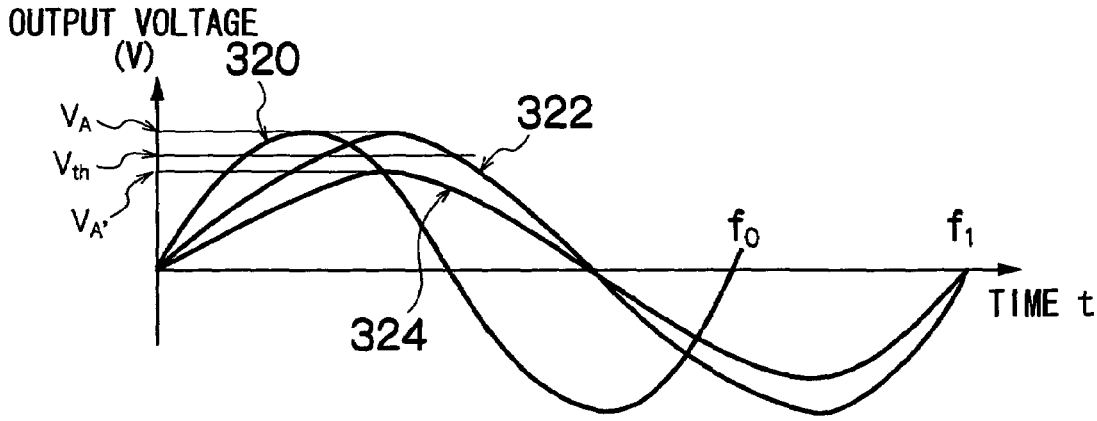
FIGS. 10A to 10C are diagrams for describing the details of the frequency characteristics shown in FIG. 9.
Figure 10B:
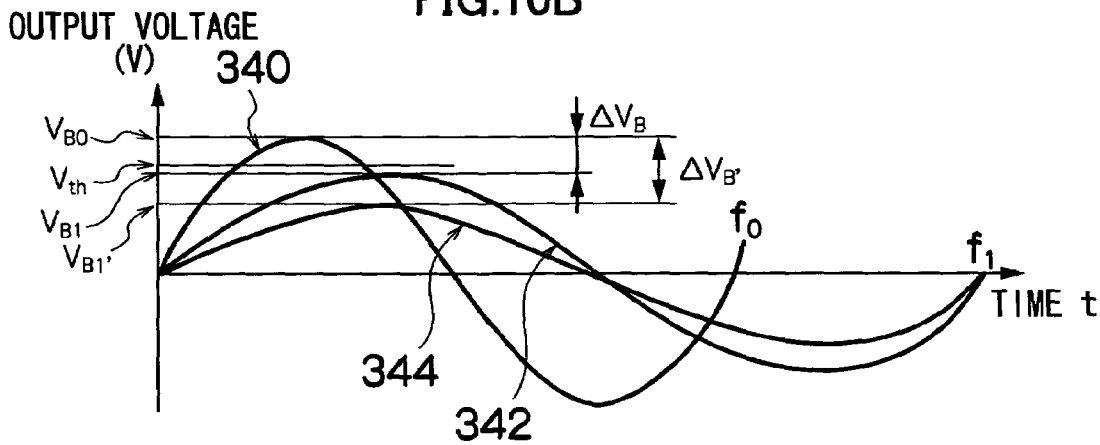
Figure 10C:
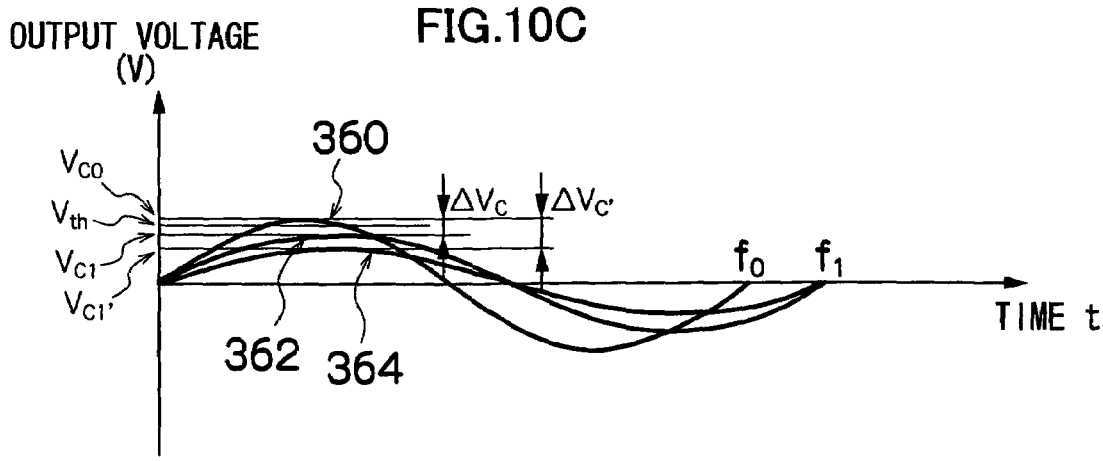

FIGS. 10A to 10C show the relationships between the time t and the output voltage V of the pressure sensor 59 corresponding to the frequency characteristics curves 302, 304 and 306 in FIG. 9. The curve 320 shown in FIG. 10A indicates the measurement signal obtained from the pressure sensor 59 during normal ejection, and since the maximum value of the output voltage V declines in direct proportion to reduction in the pressure, then the maximum value of the output voltage V is $V_A$ and the frequency of the output voltage V is $f_0$.

On the other hand, the curve 322 shows a state where the frequency of the pressure wave varies without there being pressure reduction in the pressure chamber 52. The maximum value of the output voltage V obtained from the pressure sensor 59 is $V_A$ and the frequency of the output voltage V is $f_1$. Furthermore, the curve 324 shows a state where both a reduction in the pressure of the pressure chamber 52 and a frequency variation in the pressure wave occur. The maximum value of the output voltage V obtained from the pressure sensor 59 is $V_{A'}$ and the frequency of the output voltage V is $f_1$.

When pressure abnormality (abnormal ejection) in the pressure chamber 52 is detected by using a method which determines normality and abnormality of the pressure generated in the pressure chamber 52 by comparing the maximum value of the output voltage V of the pressure sensor 59 and a prescribed threshold value ($V_{th}$ in FIG. 10A), then if the frequency of the output voltage changes, without any change in the maximum value of the output voltage V as in the curve 322 (or with very little variation in the maximum value of the output voltage V), it is not determined that there has been pressure abnormality (abnormal ejection), whereas if the maximum value of the output voltage V changes to $V_{A'}$, which is smaller than the threshold voltage $V_{th}$, as in the curve 324, then it is determined that abnormal ejection has occurred.

In other words, in the measurement method based on the measurement signal having the characteristics shown in FIG. 10A, it is impossible to detect pressure abnormality in the pressure chamber 52 that only produces a frequency variation but no pressure variation (there is no pressure reduction which goes lower than the threshold value $V_{th}$).

In the pressure abnormality determination according to the present embodiment, the capacitance $C_S$ of the pressure sensor 59 and the input resistance R of the signal processing unit 85 are set in such a manner that the frequency characteristics shown by the frequency characteristics curve 304 in FIG. 9 are achieved (in other words, in such a manner that the frequency of the pressure to be measured lies in a range below the cut-off frequency $f_{BC}$).

The curve 340 in FIG. 10B is a measurement signal obtained from the pressure sensor 59 in the case of normal ejection, where the maximum value of the output voltage V is $V_{B0}$, and the frequency of the output voltage V is $f_0$. On the other hand, the curve 342 shows a state where frequency variation occurs in the pressure wave, without there being pressure reduction in the pressure chamber 52 (corresponding to the curve 322 in FIG. 10A), and where the maximum value of the output voltage obtained from the pressure sensor 59 is $V_{B1}$ (where $V_{B0} > V_{B1}$ and $V_{th} > V_{B1}$) and the frequency of the output voltage V is $f_1$. Even in a case of this kind, by monitoring the voltage of the measurement signal obtained from the pressure sensor 59, it is still possible to detect pressure abnormality in the pressure chamber 52. Of course, if both the pressure reduction and the frequency variation in the pressure wave occur in the pressure chamber 52 as represented with the curve 344, then the output voltage obtained from the pressure sensor 59 becomes $V_{B1'}$ (where $V_{B0} > V_{B1'}$ and $V_{th} > V_{B1'}$), and by monitoring the voltage of the measurement signal obtained from the pressure sensor 59 (from the result of comparing the maximum value of the output voltage V and the threshold voltage $V_{th}$), it is possible to detect pressure abnormality in the pressure chamber 52.

In other words, if the amount of change between the maximum value of the output voltage V obtained from the pressure sensor 59 during normal ejection and the maximum value of the output voltage V obtained from the pressure sensor 59 when pressure abnormality has occurred in the pressure chamber 52 (the differentials $\Delta V_B$ and $\Delta V_{B'}$) is greater than a certain value, then it is possible to determine pressure abnormality occurring in the pressure chamber 52, by comparing the maximum value of the output voltage V with a prescribed threshold value.

FIG. 10C shows the relationship between the output voltage V in the frequency characteristics curve 306 in FIG. 9, and the time t. The curve 360 shown in FIG. 10C is a measurement signal obtained from the pressure sensor 59 in the case of normal ejection, where the maximum value of the output voltage V is $V_{C0}$ and the frequency of the output voltage V is $f_0$. On the other hand, the curve 362 shows a state in which frequency variation occurs in the pressure wave without there being pressure reduction of the pressure chamber 52 (a state corresponding to the curve 322 in FIG. 10A), and the maximum value of the output voltage V obtained from the pressure sensor 59 is $V_{C1}$ (where $V_{C0} > V_{C1}$, and $V_{th} > V_{C1}$), and the frequency of the output voltage V is $f_1$. Here, the output voltage V obtained from the pressure sensor 59 changes in accordance with the frequency variation of the pressure wave generated in the pressure chamber 53, but the amount of change $\Delta V_C$ in this output voltage V is extremely small, and it is difficult to detect pressure abnormality in the pressure chamber 52 on the basis of the result of comparing the maximum value of the output voltage V with the previously established threshold voltage $V_{th}$.

A measurement signal (output voltage V) that is desirable for pressure measurement as shown in the present embodiment is herein described.

It is desirable that the amount of change ΔV of the output voltage V in the pressure sensor 59 (for example, in FIG. 10B, $\Delta V_B=V_{B0}-V_{B1}$, $\Delta V_{B'}=V_{B0}-V_{B1'}$; and in FIG. 10C, $\Delta V_C=V_{C0}-V_{C1}$, $\Delta V_{C'}=V_{C0'}-V_{C1}$) when the frequency of the pressure generated in the pressure chamber 52 shifts from $f_0$ to $f_1$ is sufficiently large with respect to the measurement resolution and the noise components of the measurement signal.

For example, if the level of the noise component is 100 μV, then the amount of change ΔV in the output voltage V of the pressure sensor 59 preferably satisfies the condition: ΔV>100×5 μV. In other words, the amount of change ΔV in the output voltage V of the pressure sensor 59 preferably exceeds five times the noise component of the measurement signal.

Furthermore, if the measurement range is 10 mV, and the digital resolution (number of bits) is 256 (8-bits), then the measurement resolution is 10 mV/256=40 μV, and the amount of change ΔV in the output voltage V of the pressure sensor 59 preferably exceeds five times this measurement resolution (i.e., ΔV>200 μV (40 μV×5)).

In other words, if the conditions relating to the noise component and the measurement resolution are considered, then the amount of change ΔV in the output voltage V preferably satisfies the condition of exceeding five times the level of the noise component.

Furthermore, in the pressure measurement according to the present embodiment, the amount of change $\Delta f$ ($=f_1-f_0$) in the frequency when the frequency shifts from $f_0$ to $f_1$ is considered to be approximately 10% (i.e., $f_1=f_0\times0.9$), and the amount of change ΔV of the output voltage V is also approximately 10%. From these conditions, in order for the amount of change ΔV in the output voltage V to exceed 500 mV, the maximum value of the output voltage V (for example, $V_{B0}$ in FIGS. 9 and 10B) preferably satisfies the condition of exceeding 500 μV/0.1=5 mV (i.e., $V_{B0}$>5 mV).

Since the head 50 having the composition described above comprises the pressure sensor 59 for each pressure chamber 52, and is composed in such a manner that the frequency of the measurement signal (output voltage V) obtained from each pressure sensor 59 (namely, the frequency $f_S$ to be measured) is less than the cut-off frequency $f_C$, then the output voltage V changes in accordance with the change in the frequency, and the amount of change ΔV in the output voltage V is sufficiently large. Therefore, it is possible accurately to ascertain the frequency change in the pressure (pressure wave) occurring in the pressure chambers 52, by monitoring the output voltage V of each of the pressure sensors 59. An abnormal ejection in the nozzle 51 connected to a particular pressure chamber 52 is detected the basis of the result of the pressure variation in that pressure chamber 52, which is determined as described above.

Pressure abnormality accompanying pressure variation in the pressure chamber 52 which can be determined by the pressure measurement according to the present embodiment may be caused by presence of a bubble in the pressure chamber 52, temperature variation in the pressure chamber 52 (or in the ink inside the pressure chamber 52), variation in the ink viscosity inside the pressure chamber 52, drive abnormality in the piezoelectric actuator 58, or other causes.

Second Embodiment

Next, a second embodiment of the present invention is described. In the head 50 according to the second embodiment, the surface area (size) S of the individual electrode 60 of each pressure sensor 59, and the thickness T of the pressure sensor 59, are set in such a manner that the conditions relating to the measurement signal (output voltage V) indicated in the first embodiment described above are satisfied.

Figure 11:
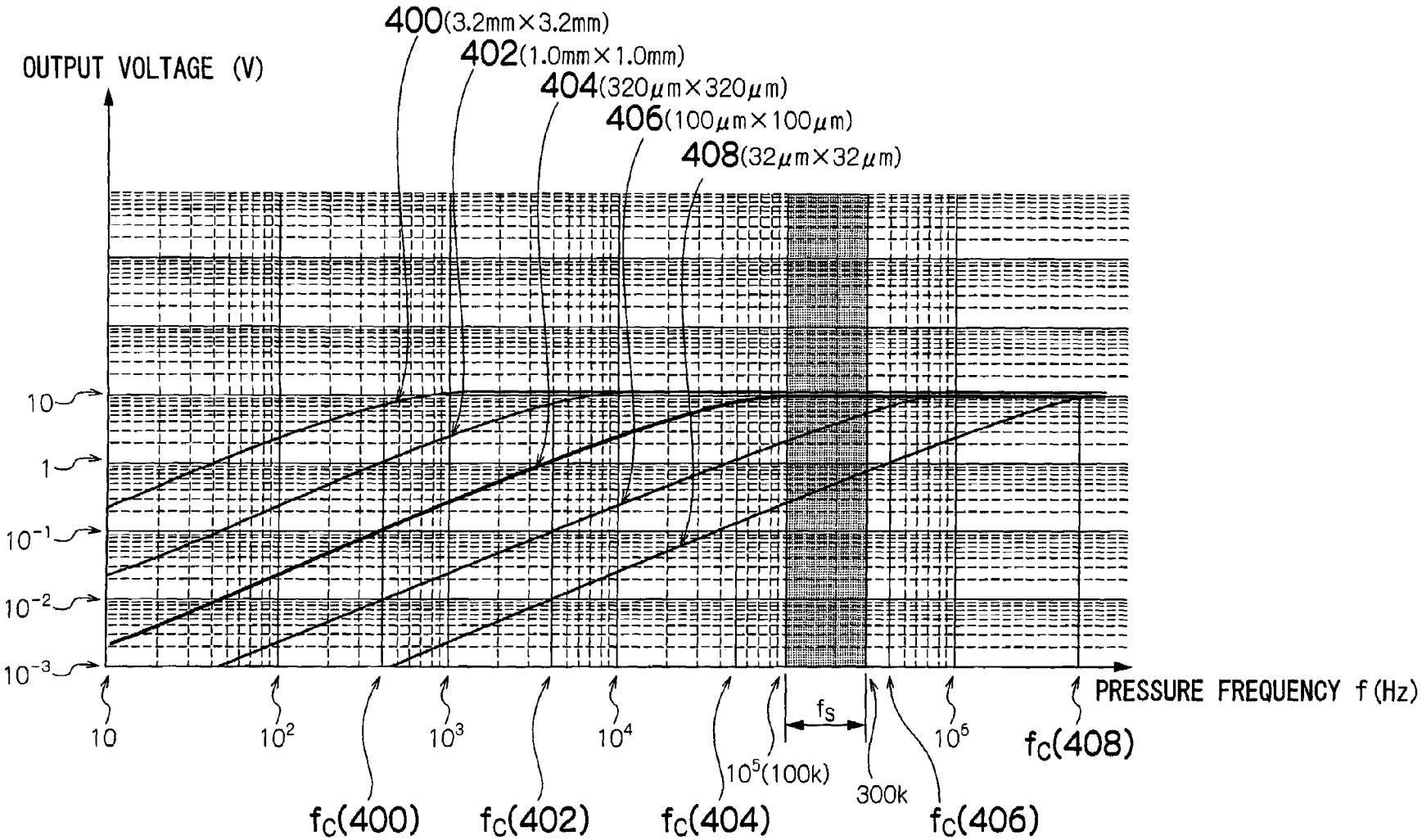
FIG. 11 is a diagram showing the relationship between the size of the individual electrode provided on the pressure sensor shown in FIG. 4, and the frequency characteristics of the measurement signal.

FIG. 11 shows the relationship between the output voltage V of the pressure sensor 59 and the pressure frequency f, depending on variation in the surface area S of the individual electrode 60 of the pressure sensor 59. In FIG. 11, curve 400 shows a case where the size of the individual electrode 60 is 3.2 mm×3.2 mm, and curves 402, 404, 406 and 408 respectively show cases where the size of the individual electrode 60 is 1 mm×1 mm, 320 μm×320 μm, 100 μm×100 μm, and 32 μm×32 μm. The value $f_C$(400) in FIG. 11 indicates the cut-off frequency of the curve 400, and the values $f_C$(402), $f_C$(404), $f_C$(406) and $f_C$(408) respectively show the cut-off frequency of the curves 402, 404, 406 and 408.

In the pressure measurement according to the present embodiment, the frequency $f_S$ of the signal to be measured is 100 kHz to 300 kHz, and in the curve 406 (S=100 μm×100 μm) and the curve 408 (S=32 μm×32 μm), the frequency of the signal to be measured satisfies the conditions of being smaller than the cut-off frequency $f_C$. More specifically, by setting the size of the individual electrode 60 of each pressure sensor 59 to be 100 μm×100 μm or 32 μm×32 μm, then it is possible to determine the frequency variation of a pressure wave having a frequency of 100 kHz to 300 kHz (range of frequency variation) by monitoring the output voltage V of the pressure sensor 59.

Figure 12:
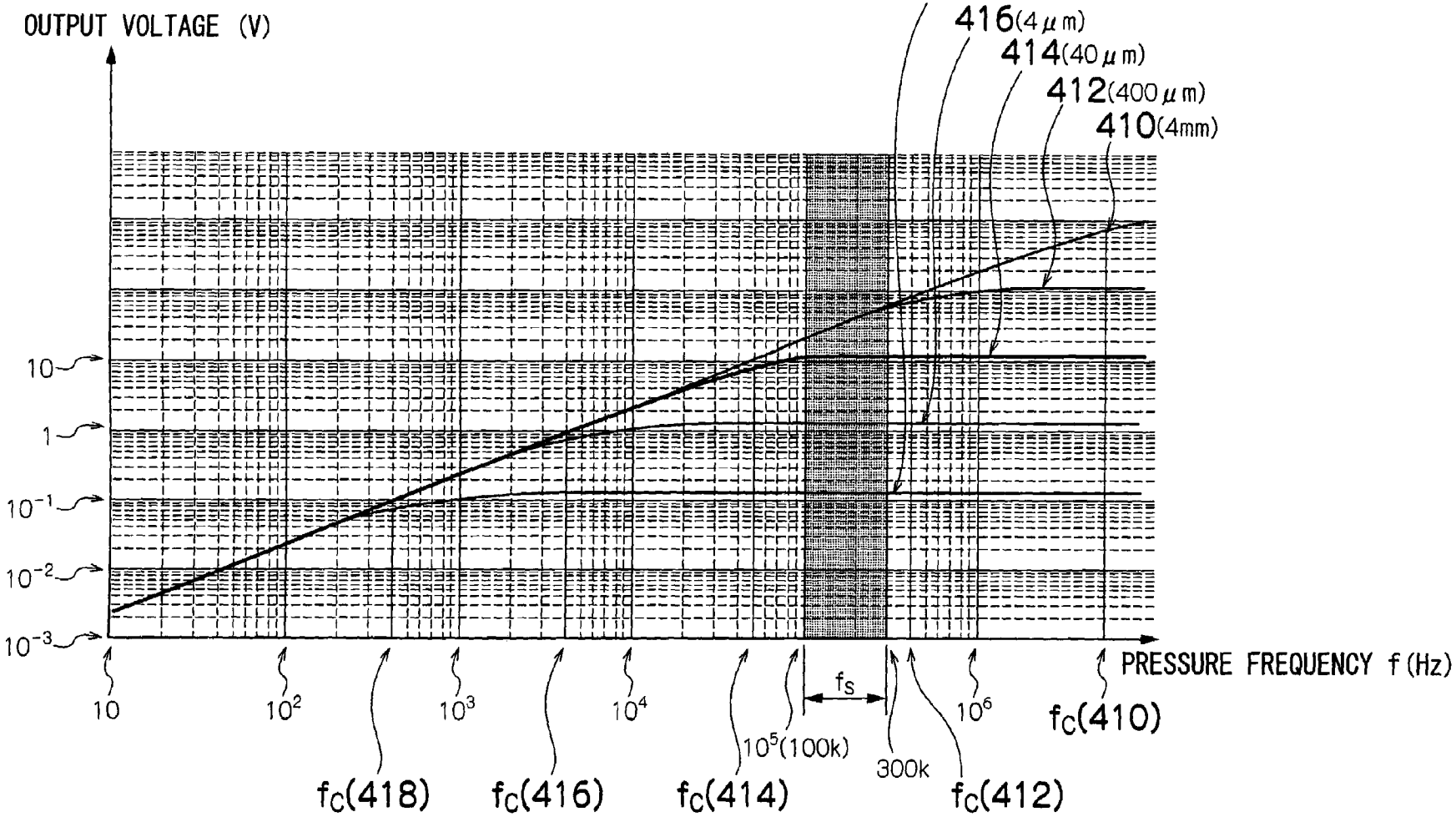
FIG. 12 is a diagram showing the relationship between the thickness of the pressure sensor shown in FIG. 4, and the frequency characteristics of the measurement signal.

FIG. 12 shows the relationship between the output voltage V of the pressure sensor 59 and the frequency f, with variation in the thickness T of the pressure sensor 59. In FIG. 12, curve 410 shows a case where the thickness T of the pressure sensor 59 is 4 mm, and curves 412, 414, 416 and 418 respectively show cases where the thickness T of the pressure sensor 59 is 400 μm, 40 μm, 4 μm, and 0.4 μm. The value $f_C$(410) shown in FIG. 12 indicates the cut-off frequency of the curve 410, and the values $f_C$(412), $f_C$(414), $f_C$(416) and $f_C$(418) respectively show the cut-off frequency of the curves 412, 414, 416 and 418.

The curve 410 (T=4 mm) and the curve 412 (T=400 μm) satisfy the condition of the frequency $f_S$ of the signal to be measured (100 kHz to 300 kHz) being lower than the cut-off frequency $f_C$. In other words, by setting the thickness T of the pressure sensor 59 to be equal to or greater than 400 μm, then it is possible to determine the frequency variation of a pressure wave having a frequency of 100 kHz to 300 kHz (range of frequency variation), by monitoring the output voltage V of the pressure sensor 59.

Figure 13A:
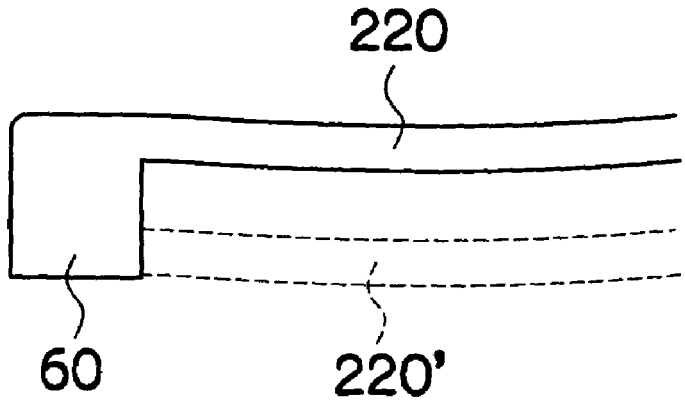
FIGS. 13A and 13B are diagrams describing a wire structure in which the wire resistance is altered.
Figure 13B:
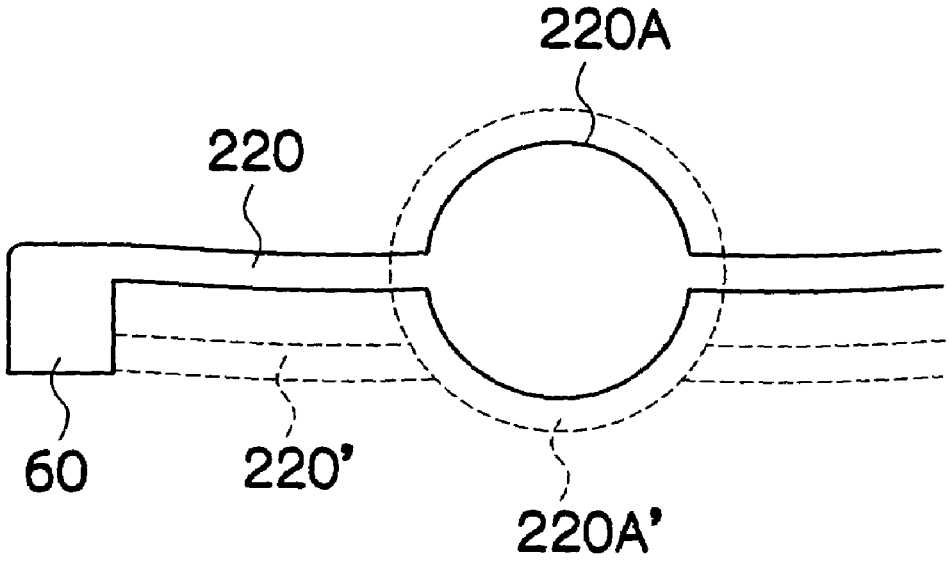

Furthermore, a composition may also be adopted in which the conditions of the curve 304 in FIG. 9 are satisfied by altering the wire resistances R1 to R4 and the wire capacitance $C_1$ of the wire 220 shown in FIG. 8. For example, it is possible to reduce the wire resistances of wires 220 and 220' in FIG. 13A by adding wide sections 220A and 220A' as shown in FIG. 13B, in which the pattern widths of the wires 220 and 220' are increased.

Since a composition is adopted in which the pressure sensors 59 have prescribed frequency characteristics, by selecting the capacitance and the internal resistance of the pressure sensors 59 by means of the surface area S of the individual electrode 60 of the pressure sensor 59 and the thickness T of the pressure sensor 59, then it is possible to determine the frequency variation in the pressure chamber 52 without using a circuit, such as a frequency filter, for extracting a specific frequency component from the measurement signal, and hence the circuit composition of the measurement system is simplified.

Third Embodiment

Next, a third embodiment of the present invention is described. In the head 50 according to the third embodiment, a resistance and a capacitor are added to the pressure sensor 59, the wires through which the measurement signal is transmitted (e.g., the wire 220 in FIG. 8), and the signal processing unit 85, in order that the conditions relating to the measurement signal (output voltage V) shown in the first embodiment described above are satisfied.

Figure 14:
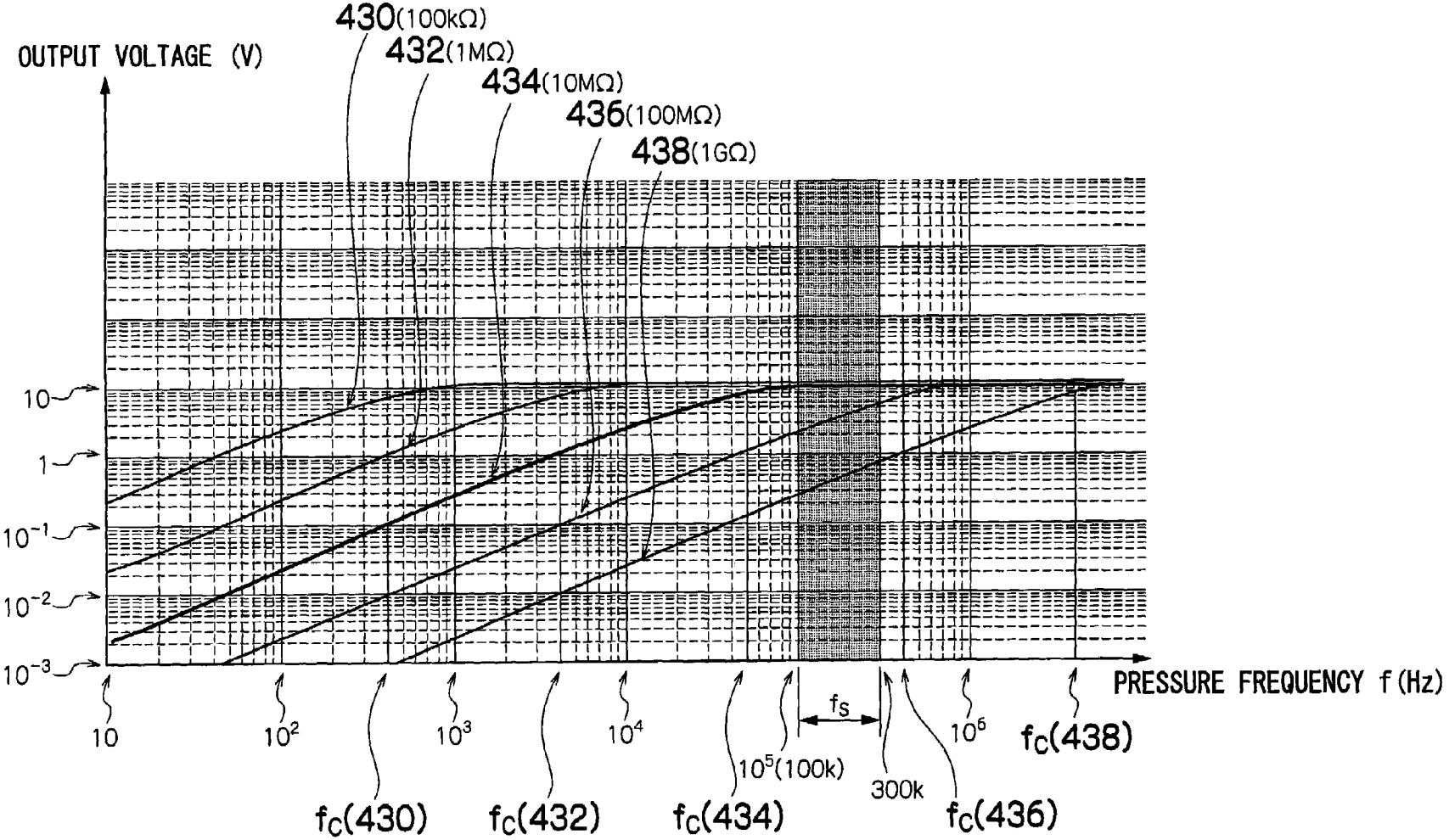
FIG. 14 is a diagram showing the relationship between the combined resistance of the input resistance of the signal processing unit shown in FIG. 8 and an additional resistor, and the frequency characteristics of the measurement signal.
Figure 15A:
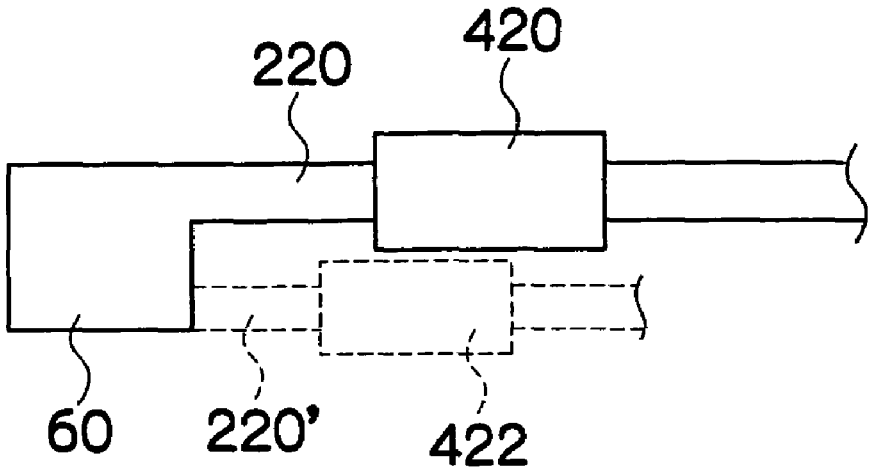
FIGS. 15A and 15B are diagrams showing an additional resistor and an additional capacitor.

FIG. 14 shows the relationship between the output voltage V of the pressure sensor 59 and the frequency f in the case where resistors 420 and 422 are added to the wires 220 and 220' as shown in FIG. 15A, with variation in the combined resistance of the input resistance 202 of the signal processing unit 85 and the resistor 420. In FIG. 14, curve 430 shows a case in which the combined resistance is 100 kΩ, and curves 432, 434, 436 and 438 respectively show cases where the combined resistance is 1 MΩ, 10 MΩ, 100 MΩ and 1 GΩ.

In FIG. 14, the value $f_C$(430) indicates the cut-off frequency of the curve 430, and the values $f_C$(432), $f_C$(434), $f_C$(436) and $f_C$(438) respectively show the cut-off frequency of the curves 432, 434, 436 and 438.

The curve 436 (where the combined resistance is 100 MΩ) and the curve 438 (where the combined resistance is 1 GΩ) satisfy the condition of the frequency $f_S$ of the signal to be measured (100 kHz to 300 kHz) being lower than the cut-off frequency $f_C$. In other words, by making the combined resistance of the input resistance 202 of the signal processing unit 85 and the resistor 420 to be equal to or greater than 100 MΩ, then it is possible to determine the frequency variation of a pressure wave having a frequency of 100 kHz to 300 kHz (range of frequency variation), by monitoring the output voltage V of the pressure sensors 59.

Figure 15B:
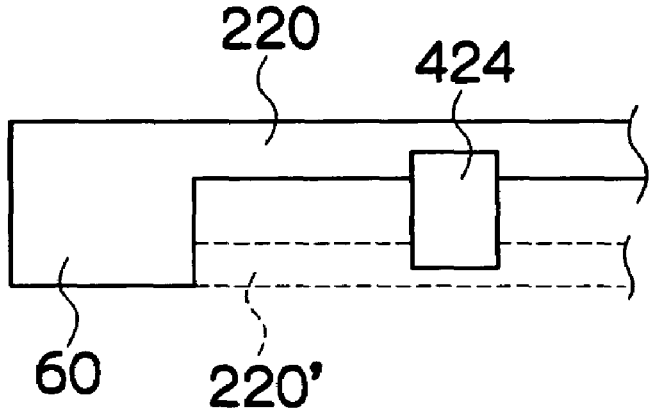

As shown in FIG. 15B, it is also possible to adopt a composition in which the conditions of the measurement signal (output voltage V) shown in the first embodiment are satisfied by adding a capacitor 424 to the wire 220. The capacitor 424 shown in FIG. 15B is inserted between the wire 220 and the wire 220', and is connected in parallel to the pressure sensor 59.

The resistors 420 and 422 shown in FIG. 15A are connected in series to the wire resistances R1 to R4 shown in FIG. 8, and chip resistors or print resistors are suitable for use for the resistors 420 and 422. The capacitor 424 shown in FIG. 15B is connected in parallel to the pressure sensor 59, and a chip capacitor (ceramic capacitor) is suitable for use as the capacitor 424. It is also possible to use a piezoelectric body having a prescribed capacitance, instead of the capacitor 424.

In the foregoing embodiment, the inkjet recording apparatus 10 using page-wide full line type heads 50 (12K, 12C, 12M and 12Y) having nozzle rows of a length corresponding to the entire width of the recording medium 16 is described, but the scope of application of the present invention is not limited to this, and the present invention may also be applied to an inkjet recording apparatus using a shuttle head which performs image recording while moving a short recording head back and forth in a reciprocal fashion.

In the foregoing embodiment, the inkjet recording apparatus 10 forms images on recording paper 16 by ejecting ink from nozzles 51 provided in the head (inkjet head) 50, but the scope of application of the present invention is not limited to this, and it may also be applied broadly to image forming apparatuses which form images (three-dimensional shapes) by means of a liquid other than ink, such as resist, or to liquid ejection apparatuses, such as dispensers, which eject liquid chemicals, water, or the like, from nozzles (ejection holes).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

an ejection hole which ejects liquid;

a pressure chamber which accommodates the liquid to be ejected from the ejection hole;

an ejection force generating element which applies an ejection force to the liquid inside the pressure chamber; and a pressure measurement device including a capacitance-type pressure measurement element which measures pressure generated in the pressure chamber, the pressure measurement device having a resistance and a capacitance whereby frequency f and cut-off frequency $f_C$ of a measurement signal obtained from the pressure measurement element in accordance with the pressure generated in the pressure chamber satisfy a relationship of $f<f_C$.

2. The liquid ejection head as defined in claim 1, wherein the frequency f of the measurement signal includes frequency $f_0$ of the measurement signal obtained for the pressure generated in the pressure chamber during normal ejection where the liquid is ejected normally from the ejection hole.

3. The liquid ejection head as defined in claim 1, wherein the frequency f of the measurement signal includes frequency $f_1$ of the measurement signal obtained for the pressure generated in the pressure chamber during abnormal ejection where the liquid is not ejected normally from the ejection hole.

4. The liquid ejection head as defined in claim 3, wherein the abnormal ejection includes a state where a bubble is present in the pressure chamber.

5. The liquid ejection head as defined in claim 1, wherein:

the pressure measurement element has an output electrode through which the measurement signal is outputted, and the capacitance of the pressure measurement device is settled by at least one of a surface area of the output electrode, and a thickness of the pressure measurement element.

6. The liquid ejection head as defined in claim 1, wherein:

the pressure measurement device has a signal transmission path which transmits the measurement signal obtained from the pressure measurement element; and the resistance of the pressure measurement device includes a resistance of the signal transmission path, and the capacitance of the pressure measurement device includes a capacitance of the signal transmission path.

7. The liquid ejection head as defined in claim 6, wherein the resistance of the pressure measurement device includes resistance of a resistor added to the signal transmission path, and the capacitance of the pressure measurement device includes capacitance of a capacitor added to the signal transmission path.

8. A liquid ejection apparatus, comprising:

a liquid ejection head which comprises: an ejection hole which ejects liquid; a pressure chamber which accommodates the liquid to be ejected from the ejection hole; an ejection force generating element which applies an ejection force to the liquid inside the pressure chamber; and a pressure measurement device including a capacitance-type pressure measurement element which measures pressure generated in the pressure chamber, the pressure measurement device having a resistance and a capacitance whereby frequency f and cut-off frequency $f_C$ of a measurement signal obtained from the pressure measurement element in accordance with the pressure generated in the pressure chamber satisfy a relationship of $f<f_C$; and a signal processing device which carries out prescribed signal processing on the measurement signal obtained from the pressure measurement element, wherein the resistance of the pressure measurement device includes an input resistance of the signal processing device.

* * * * *